US009565507B2

(12) United States Patent
Case

(10) Patent No.: US 9,565,507 B2
(45) Date of Patent: Feb. 7, 2017

(54) DESTRUCTIVE INTERFERENCE MICROPHONE

(71) Applicant: PANAMAX35, LLC, Cheyenne, WY (US)

(72) Inventor: Eliot Maxwell Case, Aurora, CO (US)

(73) Assignee: Panamax35 LLC, Cheyenne, WY (US)

( * ) Notice: Subject to any disclaimer, the term of this patent is extended or adjusted under 35 U.S.C. 154(b) by 0 days.

(21) Appl. No.: 14/652,909

(22) PCT Filed: Dec. 17, 2013

(86) PCT No.: PCT/US2013/075668
§ 371 (c)(1),
(2) Date: Jun. 17, 2015

(87) PCT Pub. No.: WO2014/099912
PCT Pub. Date: Jun. 26, 2014

(65) Prior Publication Data

US 2015/0334498 A1 Nov. 19, 2015

Related U.S. Application Data

(60) Provisional application No. 61/738,079, filed on Dec. 17, 2012.

(51) Int. Cl.
*H04R 29/00* (2006.01)
*H04R 1/08* (2006.01)
*H04R 9/08* (2006.01)

(52) U.S. Cl.
CPC ..... *H04R 29/004* (2013.01); *H04R 1/08* (2013.01); *H04R 9/08* (2013.01); *H04R 2201/405* (2013.01); *H04R 2430/25* (2013.01)

(58) Field of Classification Search
CPC ..... H04R 29/004; H04R 1/08
USPC ..... 181/125; 356/480, 505, 519; 381/56, 58, 381/72, 89, 92, 94.1, 94.7, 173; 385/12; 709/220; 342/442; 345/173; 455/569.1; 600/300; 701/443; 702/185; 704/200.1, 704/233, 274; 725/20
See application file for complete search history.

(56) References Cited

U.S. PATENT DOCUMENTS 4,268,719 A * 5/1981 Manger ..... H04R 1/02 181/144
4,379,211 A * 4/1983 Joscelyn ..... H04R 1/04 381/173
4,833,719 A * 5/1989 Carme ..... G10K 11/1788 381/71.6
6,587,786 B1 * 7/2003 La Rue ..... B60R 16/0373 701/428

(Continued)

*Primary Examiner* — Gerald Gauthier
(74) *Attorney, Agent, or Firm* — McKee, Voorhees & Sease, PLC

(57) ABSTRACT

A higher-order acoustical pressure measurement device (e.g., microphone) is disclosed. The device includes a first acoustic pressure measurement from a generally concentrated spatial location and a second acoustic pressure measurement having a spatiality greater than the concentrated spatial location of the first acoustic pressure measurement and at least one destructive interference signal. The destructive interference signal is characterized at least in part by the spatiality of the second acoustic pressure measurement. A higher-order microphone includes sensor elements configured to provide a destructive interference signal such that interference at one sensor element is configured to lower the destructive interference signal for the primary direction of directivity from a source signal.

30 Claims, 21 Drawing Sheets

(56) References Cited

U.S. PATENT DOCUMENTS 6,647,548 B1 * 11/2003 Lu ..... H04H 60/44 725/13
7,561,700 B1 * 7/2009 Bernardi ..... H04R 29/006 381/313
8,098,844 B2 * 1/2012 Elko ..... H04R 3/005 381/122
8,265,937 B2 * 9/2012 Griffin ..... G10K 15/20 704/226
2001/0021905 A1 * 9/2001 Burnett ..... A61B 5/0507 704/233
2002/0116177 A1 * 8/2002 Bu ..... G10L 15/20 704/200.1
2002/0143242 A1 * 10/2002 Nemirovski ..... H04B 1/3877 600/300
2004/0071383 A1 * 4/2004 Balachandran .... G01D 5/35303 385/12
2004/0130728 A1 * 7/2004 Degertekin ..... G01B 11/026 356/505
2005/0146726 A1 * 7/2005 Balachandran .... G01D 5/35303 356/480
2006/0080418 A1 * 4/2006 Wu ..... G01H 17/00 709/220
2006/0290944 A1 * 12/2006 Arnott ..... G01N 21/1702 356/519
2007/0046540 A1 * 3/2007 Taenzer ..... G01S 7/2813 342/442
2007/0189550 A1 * 8/2007 Wu ..... G01H 3/125 381/94.1
2007/0199765 A1 * 8/2007 Bohning ..... G01S 3/808 181/125
2008/0013749 A1 * 1/2008 Konchitsky ..... H04R 1/406 381/94.7
2008/0183429 A1 * 7/2008 Piety ..... G01M 13/028 702/185
2009/0180627 A1 * 7/2009 Boehme ..... G10K 11/178 381/56
2009/0274320 A1 * 11/2009 Kino ..... G10K 11/178 381/94.7
2011/0018825 A1 * 1/2011 Kondo ..... G06F 3/0433 345/173
2012/0053931 A1 * 3/2012 Holzrichter ..... G10K 11/175 704/200.1
2012/0093339 A1 * 4/2012 Wu ..... G01S 3/8083 381/92
2012/0201391 A1 * 8/2012 Beguet ..... G01S 3/801 381/56
2013/0130749 A1 * 5/2013 Andersen ..... H04M 1/6066 455/569.1
2015/0334498 A1 * 11/2015 Case ..... H04R 9/08 381/58

* cited by examiner

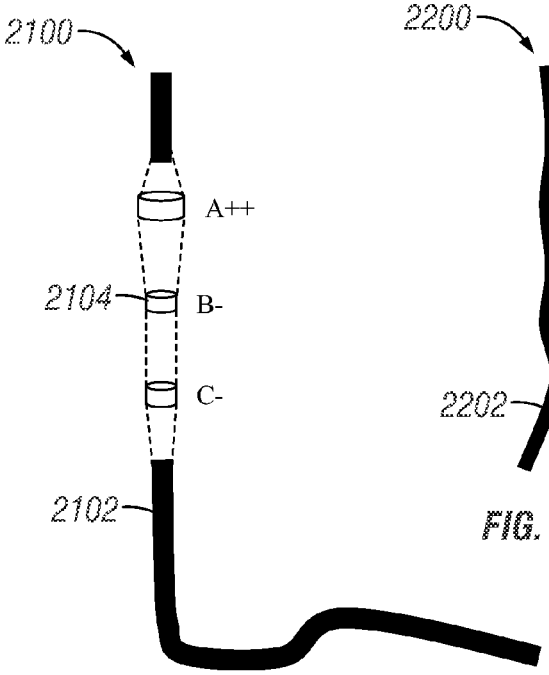
FIG. 21
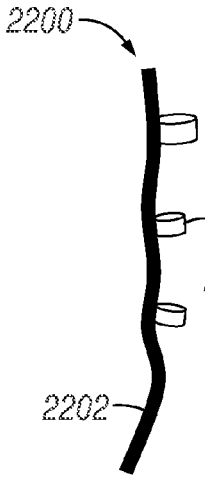
FIG. 22
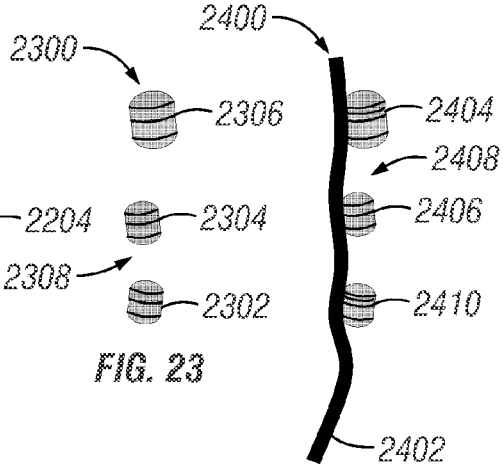
FIG. 23
FIG. 24
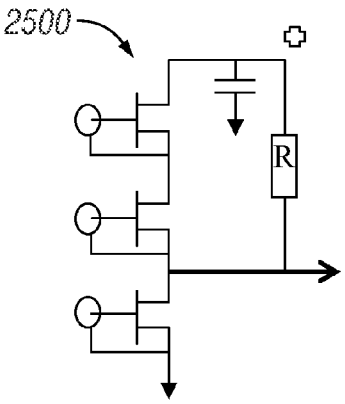
FIG. 25
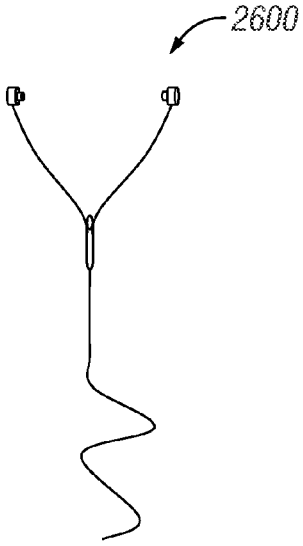
FIG. 26

| *Microphone position (port)* | *A* | *B* | *C* |
|---|---|---|---|
| Cardioid 1 | +1 | -.25 | |
| Cardioid 2 negative | | -1 | -.25 |
| = Total 2nd order cardioid ideal levels (resistance can be added to ports to optimize effect.) | +1 | -1.25 | -.25 |
| = total Effective 2nd order cardioid levels Without resistance added, still 2nd order. | +1 | -1 | +1 |

3006

| *Microphone position (port)* | *D* | *E* | *F* |
|---|---|---|---|
| Extreme mic mode - tight | +1 | -1 | -1 |
| Extreme mic mode – normal, by adding resistance to ports E and F | +1 | -.5 | -.5 |

| *Microphone position* | *A* | *B* | *C* | *D* | *E* |
|---|---|---|---|---|---|
| 1st Extreme microphone gain of 4 | +4 | -2 | -2 | | |
| 2nd Extreme microphone gain of - 2 | | -2 | +1 | +1 | |
| 3rd Extreme microphone gain of -2 | | | -2 | +1 | +1 |
| | | | | | |
| Gain for each mic element when summed | +4 | -4 | -3 | +2 | +1 |

DESTRUCTIVE INTERFERENCE MICROPHONE

CROSS-REFERENCE TO RELATED APPLICATIONS

This is a National Phase application claiming priority to PCT/US13/75668 filed Dec. 17, 2013 which claims priority under 35 U.S.C. §119 to provisional application U.S. Ser. No. 61/738,079 filed Dec. 17, 2012, all of which are herein incorporated by reference in their entireties.

BACKGROUND OF THE INVENTION

High-fidelity microphones, particularly with the advent of portable electronic devices and other applications using captured sound, are of significant interest. Particularly, higher order, including second order microphones, offering reduced size and better sound capturing and processing qualities are amongst those most highly sought after. Despite advances over the years, microphones still have pickup patterns that exhibit unwanted sound and inability to isolate a sound source in, for example, a noisy environment.

SUMMARY OF THE INVENTION

The present invention provides a destructive interference microphone and methods and systems directed to the same. One exemplary embodiment provides an acoustical pressure measurement device. The device has, amongst other things, a first acoustic pressure measurement from a generally concentrated spatial location. A second acoustic pressure measurement having a spatiality greater than the concentrated spatial location of the first acoustic pressure measurement and at least one destructive interference signal. The at least one destructive interference signal is characterized at least in part by the spatiality of the second acoustic pressure measurement. In a preferred form, the at least one destructive interference signal from the second acoustic pressure measurement is configured to decrease destruction interference from a primary direction of directivity for a source signal.

Another embodiment provides a method for an acoustical pressure measurement device. A first acoustic pressure measurement is acquired from a generally concentrated spatial location. A second acoustic pressure measurement is acquired having a spatiality greater than the concentrated spatial location of the first acoustic pressure measurement. At least destructive interference measurement from the second acoustic pressure measurement is combined with the first acoustic measurement. The at least one destructive interference measurement is characterized at least in part by the spatiality of the second acoustic pressure measurement. In a preferred form, destructive interference from a primary direction of directivity for a source signal is decreased using the at least one destructive interference measurement from the second acoustic pressure measurement.

Yet another embodiment provides a microphone. The microphone includes a body having sides extending between opposing ends. A sensor element is disposed at one end of the body. The sensor element is configured to provide a destructive interference signal. A primary direction of directivity for a source signal is also provided. Interference at the sensor is configured to lower the destructive interference signal from the primary direction of directivity from the source signal.

Still another embodiment provides a method for providing front sensitivity and no side or rear sensitivity in a higher order microphone. A body is provided having sides extending between opposing ends. A sensor element is positioned at one end of the body. The sensor element is configured to provide a destructive interference signal. A source signal is required having a primary direction of directivity. Destructive interference is used in the sensor to lower the destructive interference signal from the primary direction of directivity. In a preferred form, a rear response and a side response is generally nullified by subtracting a front response from the rear response.

BRIEF DESCRIPTION OF THE DRAWINGS

While the specification concludes with claims particularly pointing out and distinctly claiming the invention, it is believed that the various exemplary aspects of the invention will be better understood from the following description taken in conjunction with the accompanying drawings, in which:

FIG. 21 is a pictorial representation of a corded microphone array in accordance with an illustrative embodiment.

FIG. 22 is a pictorial representation of a corded array of microphone in accordance with an illustrative embodiment.

FIG. 23 is a pictorial representation of a set of covers for a microphone array in accordance with an illustrative embodiment;

FIG. 24 is a pictorial representation of a corded array of microphone covers in accordance with an illustrative embodiment.

FIG. 25 is a pictorial representation of a circuit and electret elements in accordance with an illustrative embodiment;

FIG. 26 is a pictorial representation of an ear bud cord in accordance with an illustrative embodiment.

DETAILED DESCRIPTION OF THE PREFERRED EMBODIMENTS

Figure 1:
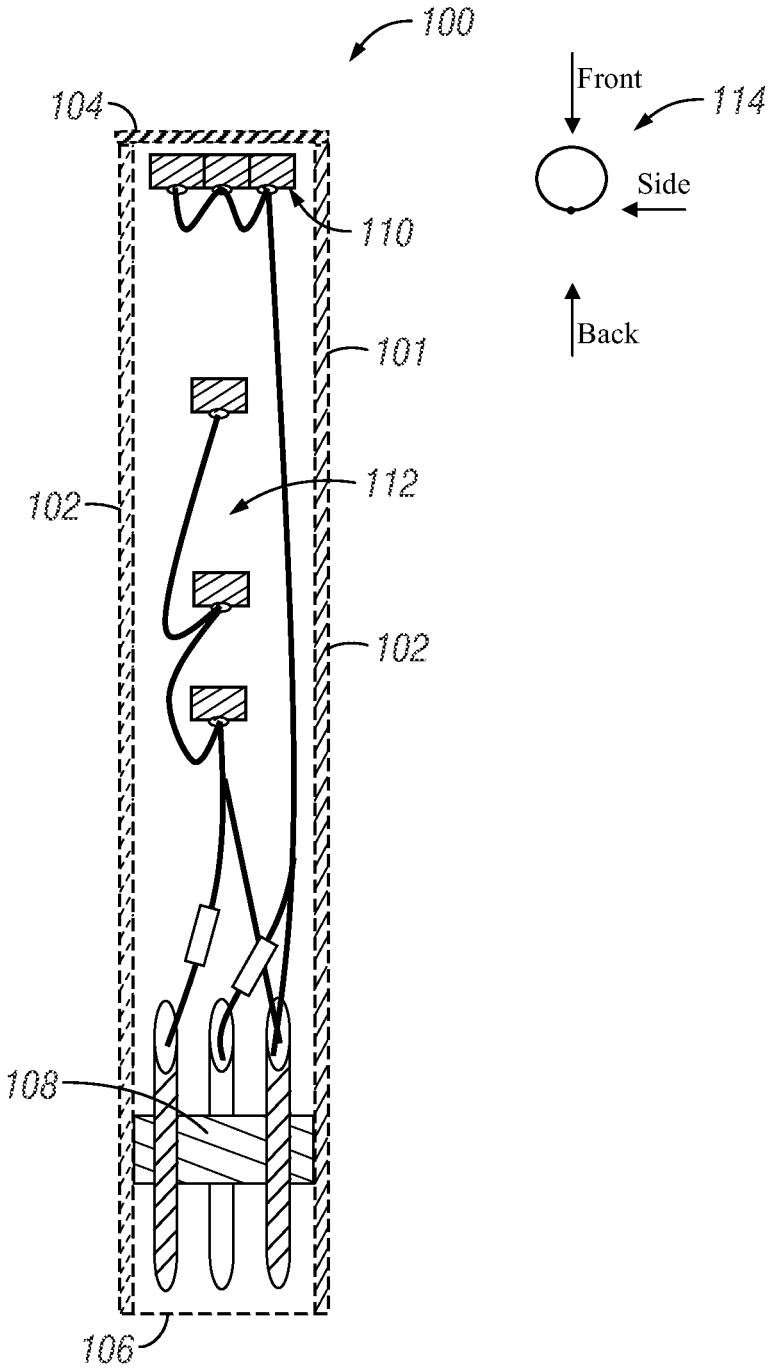
FIG. 1 is a pictorial representation of a destructive interference microphone in accordance with an illustrative embodiment.

FIGS. 1-35 illustrate exemplary aspects of a higher-order differential microphone of the disclosure. For the purpose of the disclosure, some higher-order microphones are referred to as second order differential microphones. In this case, second order infers $D^2$, where D is the distance in a differential sensor. According to one aspect of the invention a higher order differential microphone array system is provided where disruptive interference is used in a rear array to lower the destructive interference from the primary direction of directivity. Also by way of example, several embodiments or varying aspects of a higher-order (e.g., second order) differential microphones are illustrated in the figures, for example, showing a minimum number of sensor elements (e.g. 2-3) and a more complex version showing (4-6, or more) sensor elements for illustrating the breadth and scope of the disclosure and operation of the microphone. Although a number of microphone elements are disclosed, the disclosure contemplates microphone configurations and arrays from one microphone to n+1 microphones, where n may be governed, at least in part, by the various systems, configurations and implementations of the same.

According to another aspect of the invention, the microphone may be configured to fine tune the balance between a front and a back array thereby making the pick up more focused or less focused using, for example, a potentiometer to adjust the gain of, in one aspect, the rear sensor array. A simpler design of a higher-order (e.g., second order) microphone is also contemplated illustratively. For example, a microphone according to one aspect of the disclosure may be configured to operate in a boundary mode, which may be accomplished by the positioning the microphone on a surface or placing a microphone adjacent a surface forming a boundary proximate the microphone. Thus, with relative little expense, the microphone may be operated in a boundary mode according to an exemplary aspect of the present invention. In another exemplary configuration, a higher-order (e.g., second order) microphone may include a body having sides extending between a front and a rear being configured with one or more sensor elements such as microphones. For example, a pair of microphone elements (i.e., a first/front array) may be positioned at the front and a pair of microphone elements (i.e., a second/rear array) may be positioned at the opposing side on the back or rear of the body of the microphone. By controlling the spacing between the front and rear array the notch in the signal response from the rear array may generally be nullified. In a normal second order microphone, at a half wave length, there's a midpoint at the phase notch which can be generally eliminated by getting rid of the output from the rear array of the back mic thereby nullifying or eliminating the phase notch. This can be accomplished, for example, using a variable potentiometer configured to generally null the microphones between the front and the back, between the front microphone array and the back microphone array or between the first microphone array and the second microphone array. The microphone may be configured to use the annulling to balance the signal do to irregularities in, for example, connections (e.g. soldering connections).

Other microphone examples are shown and illustrated in the figures. For example, with the concept of an interference microphone, the main pick up elements in the front have a high signal-to-noise ratio unless the side and back noise is eliminated. For example, a cardioid microphone may be configured to reject a 100 percent from a back sensor or microphone array but may not be the best for eliminating a side response. Therefore, the disclosure illustrates, by way of example, one microphone design having a tight array of three sensors or microphones (e.g., cardioid microphones) exhibiting at least three times the gain and offering side and rear signal rejection. Cardioid microphones are used to provide one example; but, the present disclosure contemplates that any type of differential microphone (e.g., microphone polar patterns such as omnidirectional, super cardioid, unidirectional, bi-directional, shotgun, boundary, etc.) can be used to perform the same or similar functions according to variations that are well known in the art. Varieties of microphones alike are contemplated for one or more of the illustrated exemplary embodiments. Amongst the known varieties, the present invention contemplates using one or more, including microphones such as a ribbons or speakers. For example, a wideband version of the microphone may be configured according to an exemplary aspect of the disclosure. In one configuration, the microphone may include at least one capacitor and one coil in series with each at the output in parallel across a balanced output. The frequency response is capable of being neutralized or corrected so as to make it flat which brings the mid-range down and keeps the signal flat. In another aspect, two microphone elements may be configured separate so a first phase notch is right above the critical voice range (e.g. 3400-3700 Hertz). Examples of exemplary applications and uses of a higher-order (e.g., second order) microphone configured in this manner or a manner illustrated may be, but are not limited to, use in assistive hearing devices (e.g., non-medical), assistive listening devices (e.g., medical and a.k.a. "hearing aids"), hearing protection headphones (e.g., in mono or stereo, such as for example, a game ear for use while hunting or shooting guns), handheld microphones, computer microphones, speakerphones, professional microphones, shotgun microphones, stereo microphones, binaural microphones, binaural stereo parabolic microphone (e.g., a pair of microphone elements of the disclosure spaced apart in one parabolic reflector), cellular/mobile phones (e.g., handsets, headsets, holders, etc.), lavaliere microphones, surround sound microphones, and/or any configuration or use that has a microphone. According to another aspect of the invention, a higher-order (e.g., second order) microphone may be used for pseudo recording wherein the phase notches are positioned in the right place by adjusting the distance between the two sensor elements as shown or taught by one or more of the illustrated embodiments. The configuration of the microphone arrays (e.g. a front microphone array and a rear microphone array) may be housed in a single common housing such as a body having sides extending between a front surface and a rear surface (e.g., see FIG. 16). Therefore, what is contemplated and disclosed illustratively is a wideband, high-fi, higher-order (e.g., second order) microphone according one or more of the exemplary aspects of the disclosure. The disclosure shows, by way of examples, a microphone that provides excellent low frequency performance and creative use of destructive interference. By having front sensitivity and no side or rear sensitivity a long sought after pick-up pattern is accomplished for eliminating unwanted sound and isolation of a sound source in a noisy environment. Exemplary aspects contemplated herein, and in part above, are pictorially illustrated in FIGS. 1-35, which are hereby incorporated into the written description by reference in their entirety.

FIG. 1 is a pictorial representation of a microphone 100 in accordance with an illustrative embodiment of the present disclosure. Although a microphone 100 is shown, the concepts of the present invention may be implemented in various devices, including the aforementioned ones. Microphone 100 includes a housing 101. The housing 101 includes sides 102, front 104 and back 106. The sides may be configured from an acoustically transparent screen such as perforated metal. Some acoustic resistance at high frequencies can be added, such as from felt cloth, to improve high frequency side rejection in accordance with one aspect of the disclosure. The front 104 may be an acoustically transparent front screen such as a wire screen. The back 106 may include connectors 108 such as XLR connector with phantom powering. An exemplary configuration of one or more mic elements is provided within the housing 101. The front array 110 may be configured or disposed adjacent the front 104 of the housing 101 and a rear array 112 may be disposed or positioned toward the back 106 of the housing 101. The front array 110 may be configured to comprise three microphone elements such as three cardioid microphones. Similarly, the back array 112 may be configured from three mic elements, such as three cardioid microphones. Each of the microphones in the two arrays be wired to the connectors 108 as illustratively provided. The position of the rear array 112 may be adjusted within the housing 101 for controlling the destructive interference signal and the way in which the front array 110 and the rear array 112 are subtracted from each other resulting in a front pickup only and no side or rear response for the microphone 100. The rear array 112 is configured to have a destructive interference preventing it from making notches in the front response, but maintaining cancellation from the sides 102. The microphone elements, for example, may be configured from six electret cardioid microphones. Other microphone types are contemplated as discussed above. A polar diagram 114 provides an illustration of the response of the microphone 100 where the front 104 has sensitivity while maintaining cancellation from the sides 102 and back 106. In this manner, the microphone 100 provides a pickup pattern configured to eliminate unwanted sound and configured to isolate a sound source within a noisy environment.

Figure 2:
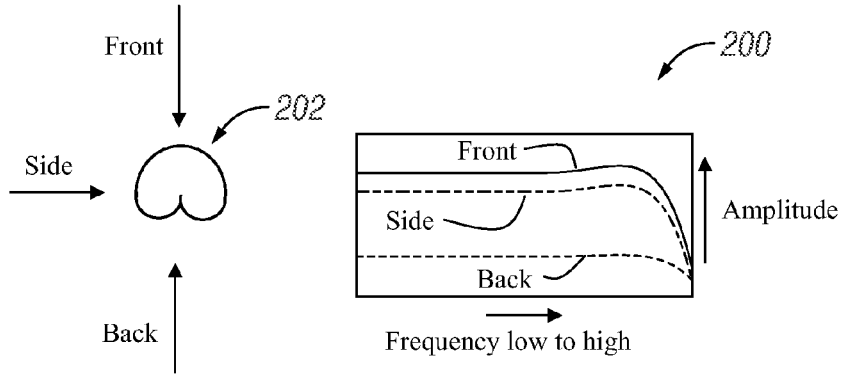
FIG. 2 is a pictorial representation of a signal order cardioid microphone in accordance with an illustrative embodiment.

FIG. 2 is a pictorial representation of another cardioid microphone 200 and polar diagram 202. Note that with a single order cardioid microphone, there is generally no response from the back as illustrated. The diagrams provided in FIG. 2 are illustrative of an ordinary microphone element.

Figure 3:
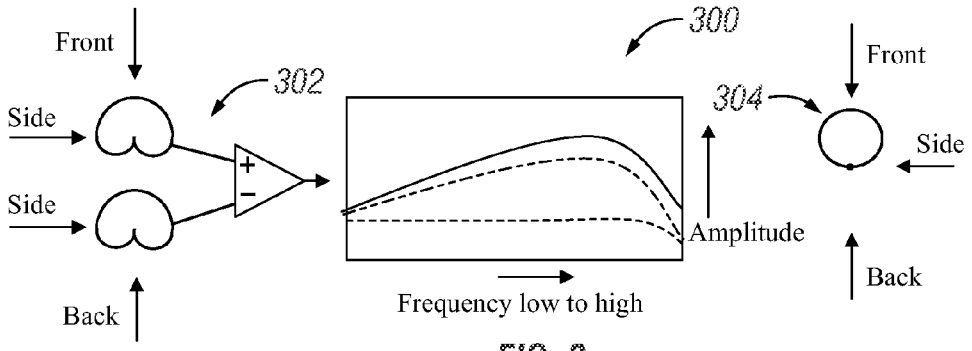
FIG. 3 is a pictorial representation of a higher-order cardioid microphone in accordance with an illustrative embodiment.

FIG. 3 is a pictorial representation of a second order cardioid microphone 300 configured to provide noise cancelling. A microphone circuit diagram 302 and polar diagram 304 are also provided for a second order cardioid microphone 300 with noise cancelling. In this embodiment, there are generally no low frequencies and the microphone elements are spaced close together. Operatively, one microphone is subtracted from the other resulting in the polar diagram 304 as illustrated. It is clear from the illustrative plot in FIG. 3 that such a configuration is only effective at noise cancelling within certain frequencies and lacks other frequencies such as low frequency.

Figure 4:
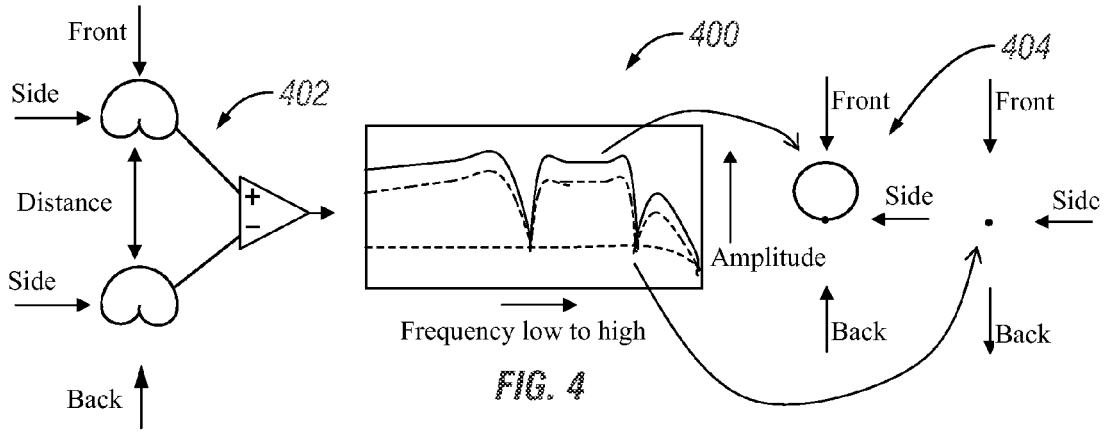
FIG. 4 is a pictorial representation of a higher-order cardioid microphone in accordance with an illustrative embodiment.

FIG. 4 is a pictorial representation of another second order cardioid microphone 400. Within the illustration is also provided a microphone circuit diagram 402 and polar diagram 404 representative of the illustrated plot. To eliminate the issue identified in the microphone 300 shown in FIG. 3 where the low frequencies are absent as illustrated by the plot, microphone 400 represents a proposed solution; however, to get the low frequencies amplitude notches are generated at high frequencies as pictorially represented by the plot and the polar diagram 404. Thus, as shown, there is generally no front response at each of the amplitude notches located in the higher frequency spectrum for the microphone 400.

Figure 5:
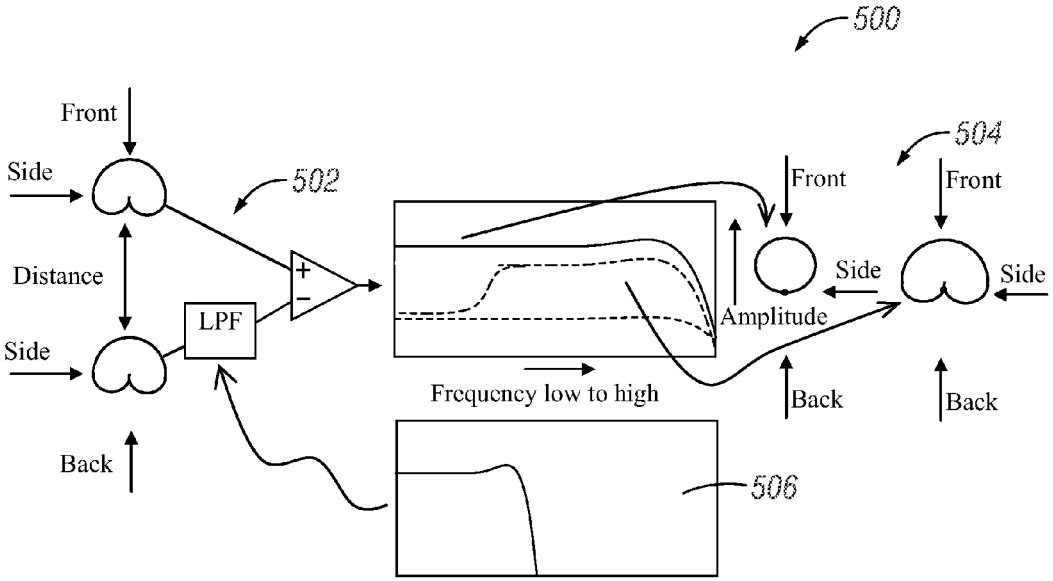
FIG. 5 is a pictorial representation of another higher-order cardioid microphone in accordance with an illustrative embodiment.

FIG. 5 provides a pictorial representation of a microphone 500 attempting to address the issues identified in FIG. 4. In FIG. 5 a microphone circuit diagram 502 and polar diagram 504 along with a plot of the low pass filter ("LPF") is provided. As illustrated by the LPF plot 506, one solution includes filtering off the high frequencies from the back microphone shown in the microphone circuit diagram 502 thus making the microphone 500 only capable of operating as a second order microphone at low frequencies and first order microphone at high frequencies.

Figure 6:
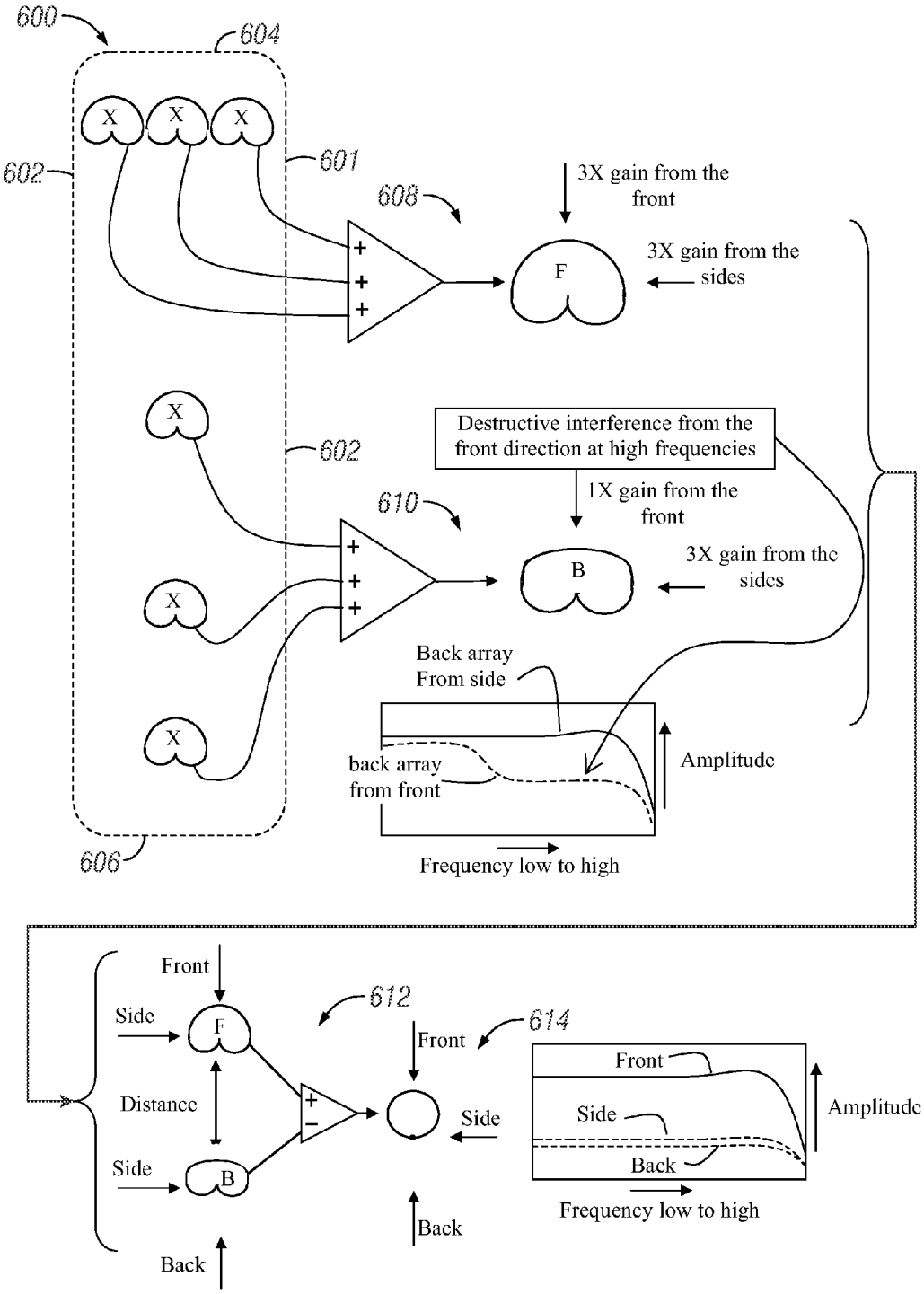
FIG. 6 is a pictorial representation of a microphone configuration and pickup pattern in accordance with an illustrative embodiment.

FIG. 6 provides a pictorial representation of a microphone 600 in accordance with an illustrative embodiment of the disclosure. Microphone 600 includes a housing 601, sides 602, front 604 and back 606. Within the housing is included an array of mic elements. The mic elements may be disposed within the housing 601 as pictorially represented or in other configurations as contemplated herein. For example, a plurality of microphone making up an array may be disposed adjacent the front 604 of the housing 601 and a plurality of mics making up another array may be positioned generally adjacent the back 606 of the housing 601. For each proposed array of microphones, a front array circuit diagram 608 and a back array circuit diagram 610 is provided illustratively. Using, for example, cardioid microphones the pickup pattern for the front array of microphones is provided by the front array circuit diagram 608. Similarly, the pickup pattern for the rear array is provided by back or rear array circuit diagram 610. A plot for the response of both arrays is provided showing the response for the back array from the side and the back array from the front. The resultant combination of the front array circuit diagram 608 or back or rear array circuit diagram 610 is shown by the combined array circuit diagram 612 and polar diagram 614. A plot provides an illustration for the frequency response of the combined array circuit diagram 612 and polar diagram 614. The disclosure contemplates that various types of microphones, including those discussed above, may be used in the disclosed arrays as long as, for example, the side array to the front array gain is balanced from the sides. Accordingly, microphone 600 is configured to have no side or rear/back response. Thus, using an intentional destructive pattern, the side and rear responses are generally annulled.

Figure 7:
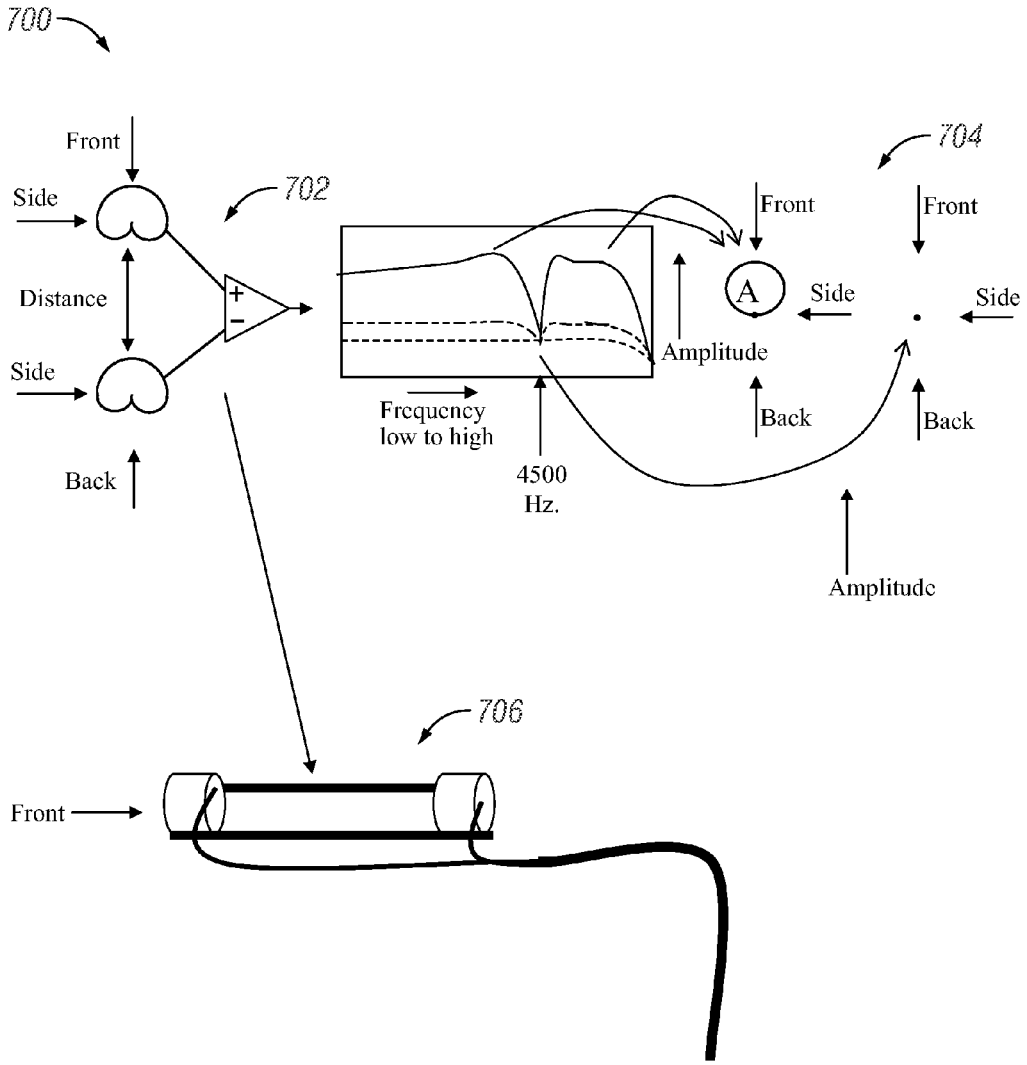
FIG. 7 is a pictorial representation of another higher-order cardioid microphone in accordance with an illustrative embodiment.

FIG. 7 is a pictorial representation of another microphone 700 in accordance with an illustrative embodiment. The microphone 700 may be configured in a manner likened to those previously disclosed or subsequently disclosed herein. A microphone circuit diagram 702 and polar diagram 704 are shown for an exemplary model 706 of microphone 700. By way of example, microphone 700 may be configured to have a first notch placed above critical frequencies for human speech. In this manner, the microphone 700 gives the impression of a full bandwidth without interfering with speech. Such a configuration provides a high fidelity sound because of the extended high frequencies. In one configuration, the microphone 700 may be configured having a front microphone element and a rear or back microphone element spaced apart such as provided illustratively by model 706. The microphone elements may be configured as two electret cardioid microphones or other like microphone pairings.

Figure 8:
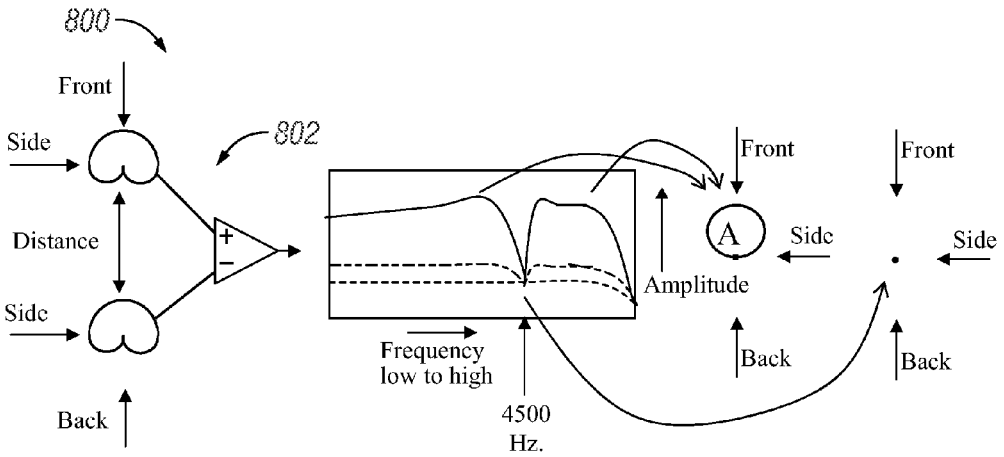
FIG. 8 is a pictorial representation of yet another higher-order cardioid microphone in accordance with an illustrative embodiment.

FIG. 8 provides a pictorial representation of a microphone 800 in accordance with an illustrative embodiment. Microphone 800 may be configured as a higher order (e.g., second order) cardioid microphone. Using two different frequencies, the microphones may be added together or one to each ear to replicate stereo sound. Microphone circuit diagram 802 and polar diagram 804 provide pictorial representation of the configuration of microphone 800 using cardioid microphone pairings. A phase notch, for example, is pictorially represented at 4500 Hz by the plot in FIG. 8. Another pictorial representation of a microphone 900 is provided in accordance with an illustrative embodiment in FIG. 9. The microphone 900 may be configured as a second order or higher order cardioid microphone. Microphone circuit diagram 902 and polar diagram 904 illustrate the response of microphone 900. A phase notch, for example, is created by the configuration of microphone 900 at 9,000 Hz as pictorially represented.

Figure 9:
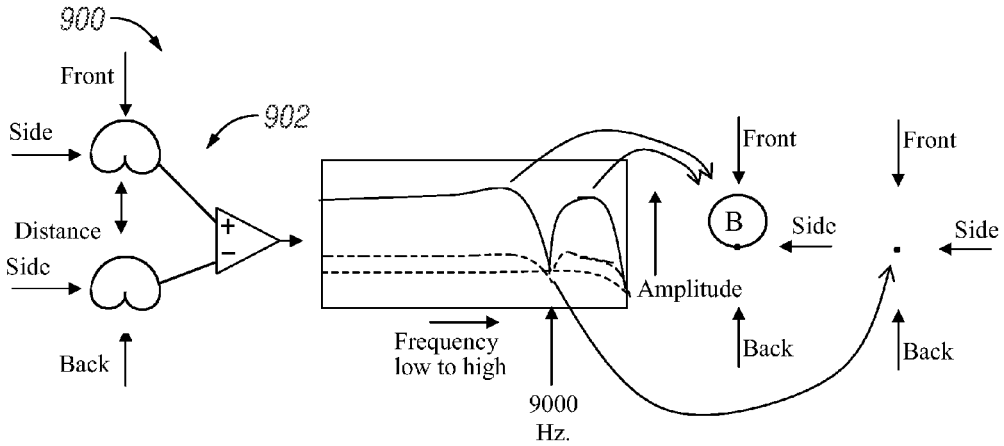
FIG. 9 is a pictorial representation of yet another higher-order microphone configuration in accordance with an illustrative embodiment.
Figure 10:
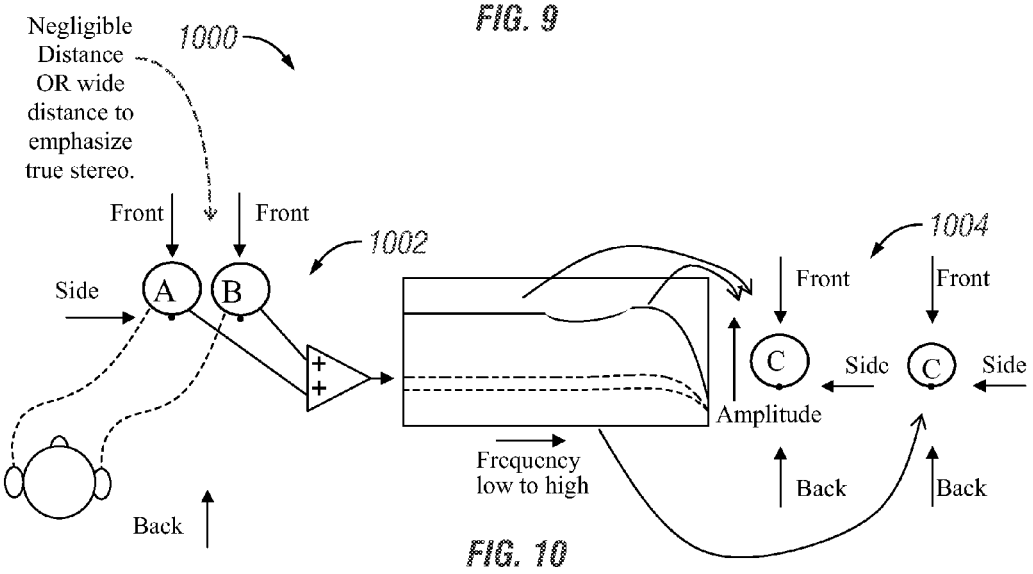
FIG. 10 is a pictorial representation of another microphone configuration in accordance with an illustrative embodiment.

FIG. 10 provides a pictorial representation of a microphone 1000 where the two different phase notches provided pictorially in FIG. 8 and FIG. 9 are added together. The result is the addition of the two phase notches covers up the notches, leaving a small front dip in performance as represented by the plot in FIG. 10. A microphone circuit diagram 1002 and polar diagram 1004 are also provided in FIG. 10. The microphone elements A and B illustrated in the microphone circuit diagram 1002 may be separated by negligible distance or a wide distance to emphasize a true stereo response as provided pictorially by the polar diagram 1004 representing the illustrated plot.

Figure 11:
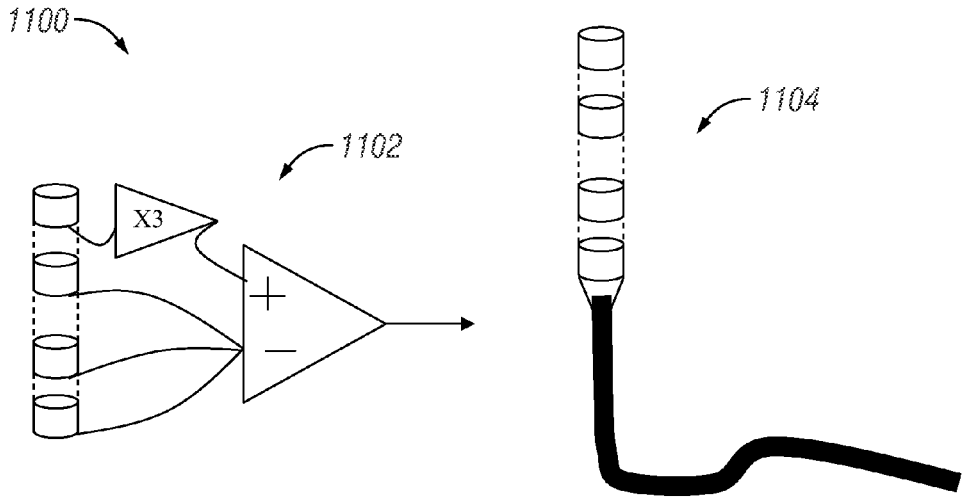
FIG. 11 is a pictorial representation of yet another microphone configuration in accordance with an illustrative embodiment.

FIG. 11 provides a pictorial representation of a microphone 1100, microphone circuit diagram 1102 and exemplary model 1104 for microphone 1100. Microphone circuit diagram 1102 includes a plurality of microphone elements arranged as shown. The microphone elements may be cardioid microphones or other microphones as set forth herein. For example, one or more on the directional microphone elements may be configured to provide the response of a cardioid microphone element. A model 1104 of a configuration of the microphones is provided showing a cord to which the microphones could be operatively attached. The polar circuit diagram 1102 of the microphone 1100 provides an example of a low profile, high fidelity microphone 1100. For example, the gain of a single first microphone element may be multiplied by the number of rear microphone elements as provided pictorially in microphone circuit diagram 1102. According to other embodiments, the gain of the front microphone element may be increased to account for the rear or conversely, the front may be increased to match the cumulative gain of the rear array of microphone elements. As provided illustratively, the microphone 1100 may be configured whereby the front array includes only a single microphone element or sensor. In this manner, the first microphone element may be configured to act as an array whereby the sum of the rear microphone elements (collecting, for example, from the rear and back) match or have the opposite polarity of the front microphone element acting as an array. The microphone 1100 may be configured using omnidirectional microphones, cardioid microphones, or super cardioid microphones, to name just a few. The microphone elements may be disposed within a flexible cord such as a microphone cord provided by the model 1104 in FIG. 11.

Figure 12:
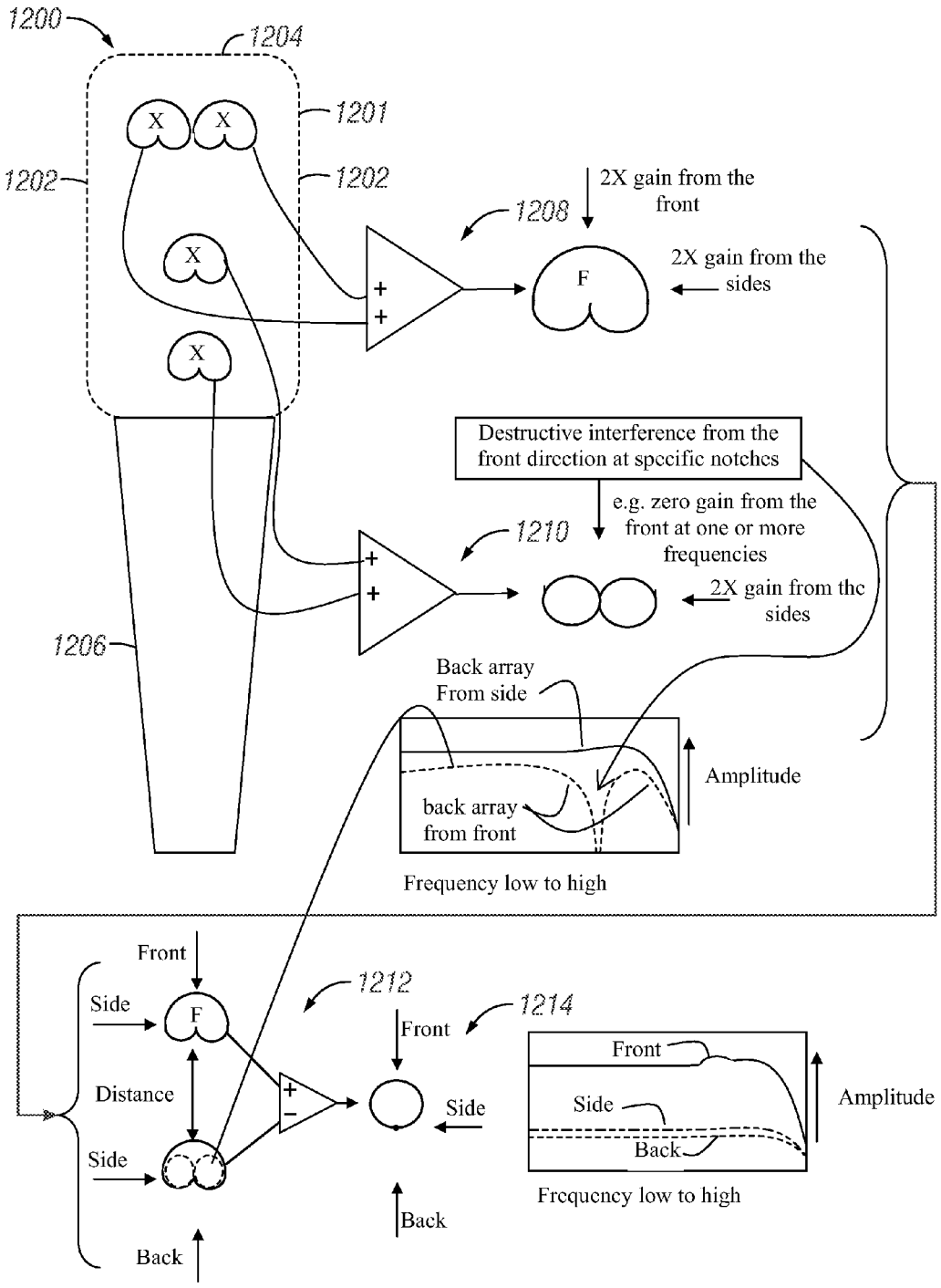
FIG. 12 is a pictorial representation of another microphone configuration and pickup pattern in accordance with an illustrative embodiment.

FIG. 12 provides a pictorial representation of a microphone 1200 in accordance with an illustrative embodiment. The microphone 1200 may be configured as a handheld microphone with a handle 1206 attached to a housing 1201 having a front 1204 and sides 1202. Within the housing 1201, a front and rear array of microphone elements may be configured as previously described or as presented pictorially in FIG. 12. A front array circuit diagram 1208 provides a pictorial representation of the response from the front microphone elements and a back array circuit diagram 1210 provides a pictorial representation of the response from the back or rear microphone elements within the housing 1201. A plot provides a pictorial representation of the combined array circuit diagram 1212 and polar diagram 1214. As pictorially represented, the side array to the front array gain is balanced from the sides. By using destructive interference from the front direction at specific notches, zero gain from the front at one or more frequencies is achieved as pictorially represented by the plot showing the combination array circuit diagram 1212 and polar diagram 1214.

Figure 13:
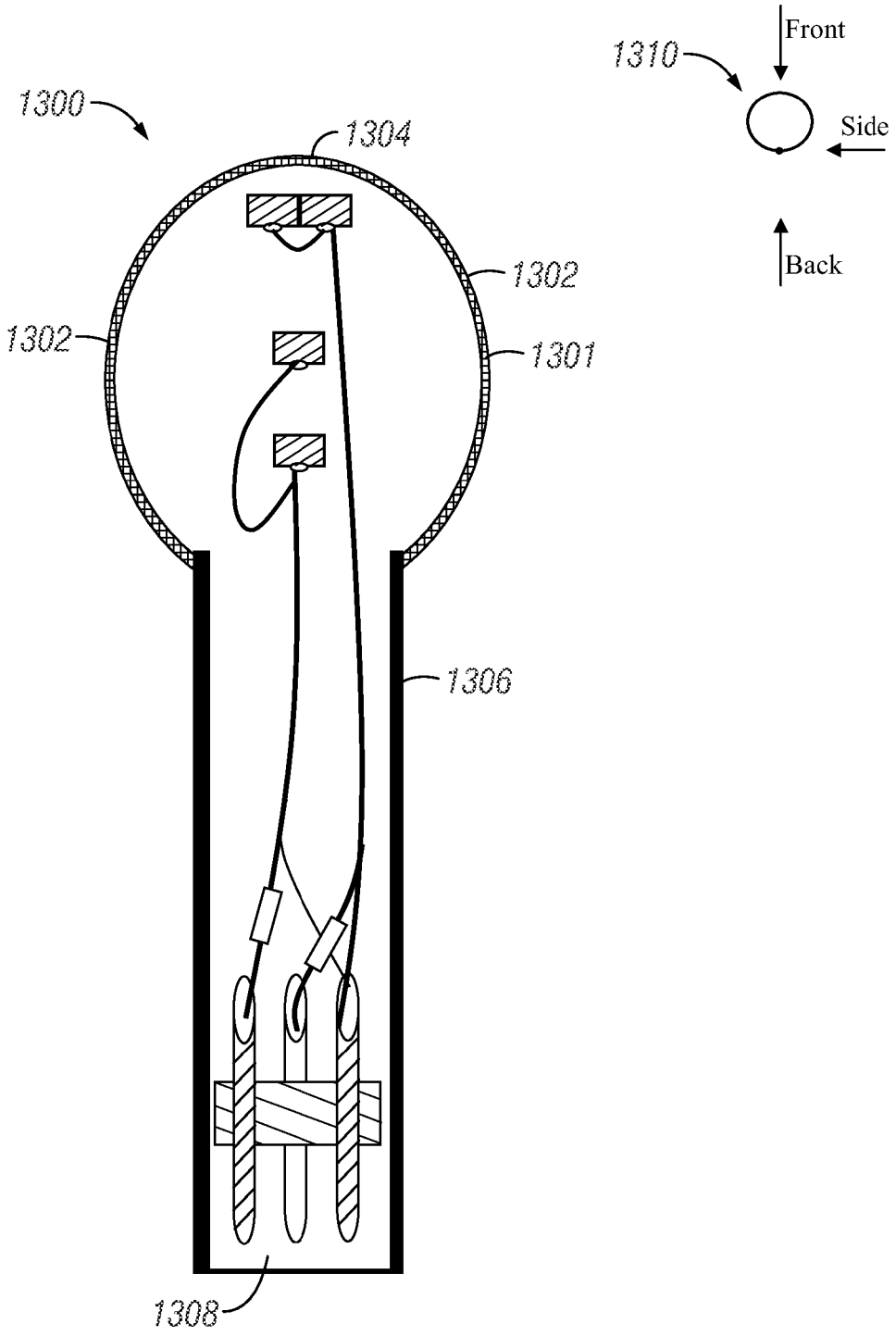
FIG. 13 is a pictorial representation of a handheld microphone configuration in accordance with an illustrative embodiment.

FIG. 13 provides a pictorial representation of another microphone 1300 in accordance with an illustrative embodiment. Microphone 1300 includes a handle 1306 operatively attached to a housing 1301 having a front 1304 and sides 1302. As previously mentioned, the housing 1301 may be configured from an acoustically transparent material such as a wire screen. The housing may be configured to having some acoustic resistance at high frequencies by adding other materials such as a felt cloth or other like acoustically beneficial materials to improve high frequency side rejection. One or more microphone elements are configured within the housing 1301 and operatively connected to the connector 1308 (e.g., XLR connector with phantom powering). A polar diagram 1310 is provided showing the response for the microphone 1300. One or more microphone elements may be included in a front microphone array and similar one or more microphone elements may be included in a rear or back microphone array. The spacing of the back microphone array, the front microphone array and the distance between the two microphone arrays may be configured to improve high frequency side rejection as represented pictorially by the polar diagram 1310. In this manner, the two microphone elements in the back array are added to get destructive interference which is then combined with the front microphone array. By controlling the distance or space between the front and rear microphone arrays, the microphone 1300 may be configured to generally nullify the notch in the frequency response from the rear array.

Figure 14:
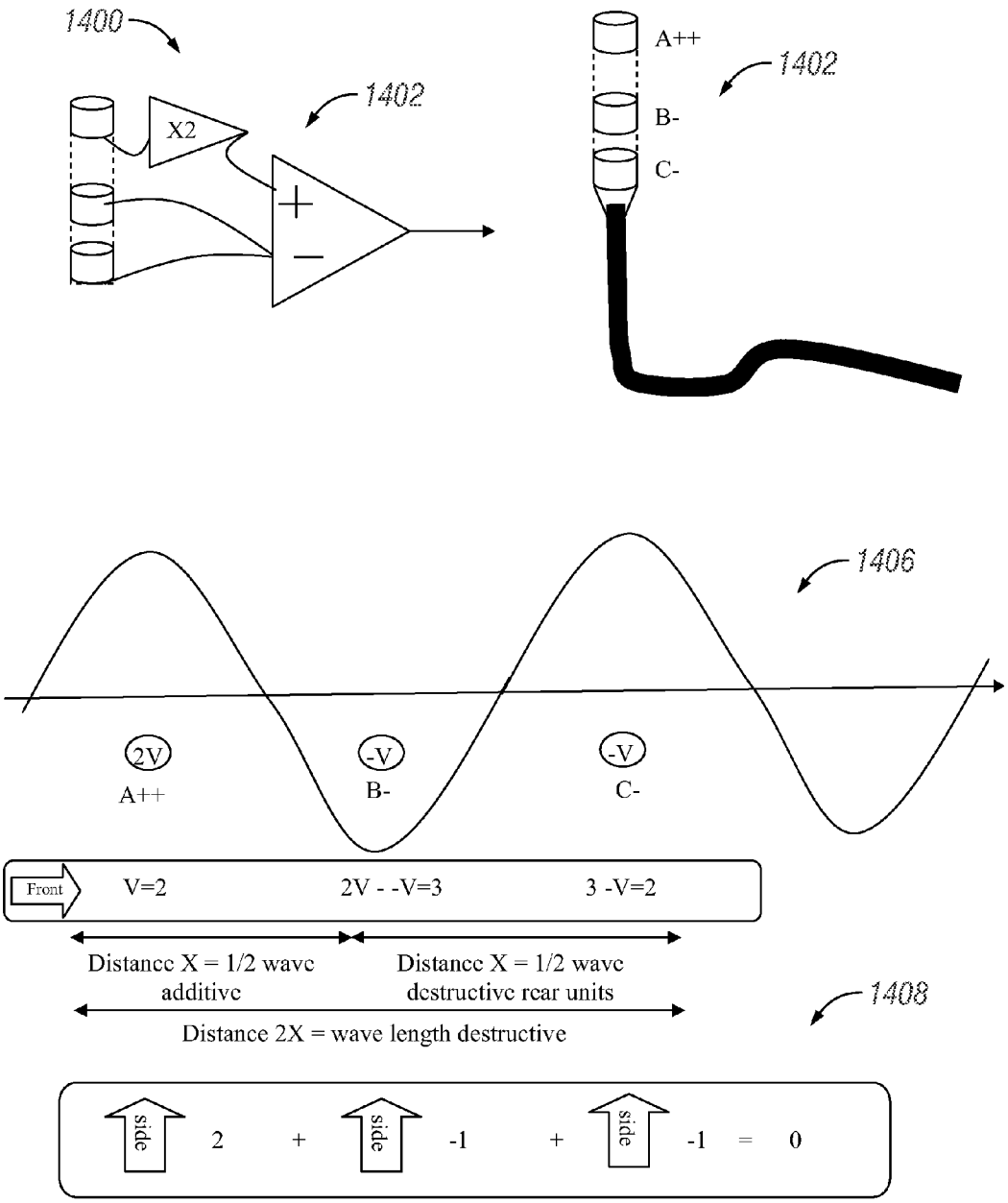
FIG. 14 is a pictorial representation of a microphone configuration and destructive interference pattern in accordance with an illustrative embodiment.

FIG. 14 provides a pictorial representation of a microphone 1400 in accordance with an illustrative embodiment. A microphone circuit diagram 1402 and exemplary model of a microphone 1404 are provided. The microphone circuit diagram illustrates an array of microphones configured in accordance with a low profile rendition of a microphone in accordance with an illustrative embodiment of the present disclosure. The front microphone array may include a single microphone element such as a cardioid microphone and the rear microphone array may include one or more microphone elements such as cardioid microphone and the rear microphone array may include one or more microphone elements such as cardioid microphone elements. The gain, for example, of a single first microphone element may be configured whereby it is multiplied by the number of rear microphone elements. The microphone elements may be configured in a corded embodiment such as on a flexible cord. A phase diagram 1406 is provided showing the response of the microphone 1400. Similarly, an interference diagram 1408 is provided showing the interference response of the microphone 1400. According to the disclosed embodiment, the first microphone element or array is in positive phase and the other two microphone elements or arrays are in negative phase spectrally represented by the phase diagram 1406. By controlling the space between the front microphone or array and the rear microphone or array, the microphone 1400 may be configured to generally nullify the notch from the rear microphone or rear microphone array as pictorially represented by the interference diagram 1408. Exemplary spacing for the microphone elements, such as in compact configuration (e.g., a flexible corded microphone 1402), may be configured whereby the rear microphone elements are neutralized from front microphone element sound sources yet fully destructive for sounds from the sides.

Figure 15:
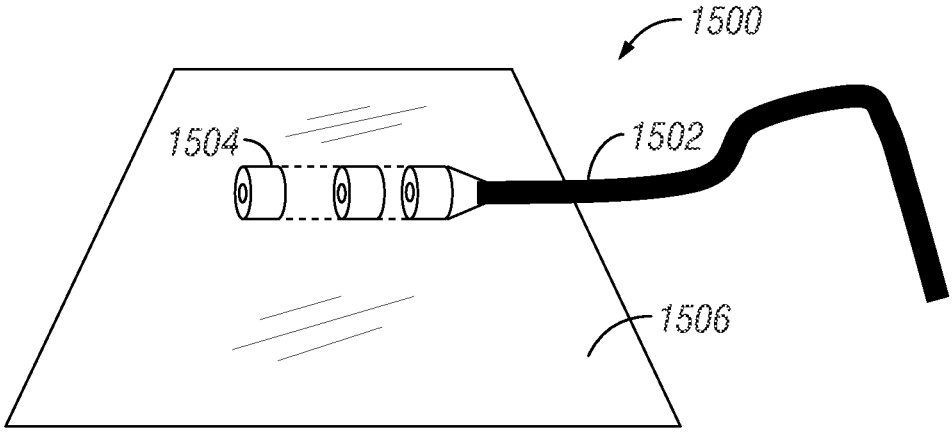
FIG. 15 is a pictorial representation of a microphone in boundary mode in accordance with an illustrative embodiment.

FIG. 15 provides a pictorial representation of a microphone 1500 that includes a cord 1502 operatively configured with an array of microphone elements 1504 positioned or disposed adjacent a boundary 1506. The microphone elements may be configured as cardioid microphones or other like microphone elements as contemplated herein. The microphone 1500 may be operated in boundary mode by placing the microphone array 1504 on its side on a boundary 1506 or surface with the axis sensitivity parallel to the boundary 1506 thereby limiting pickup from the boundary side and minimizing phase cancellation interference. Furthermore, multiple microphone elements may be configured on a boundary 1506 pointing at different angles, for example, in a conference room or a speaker phone to achieve the objectives of the present disclosure.

Figure 16:
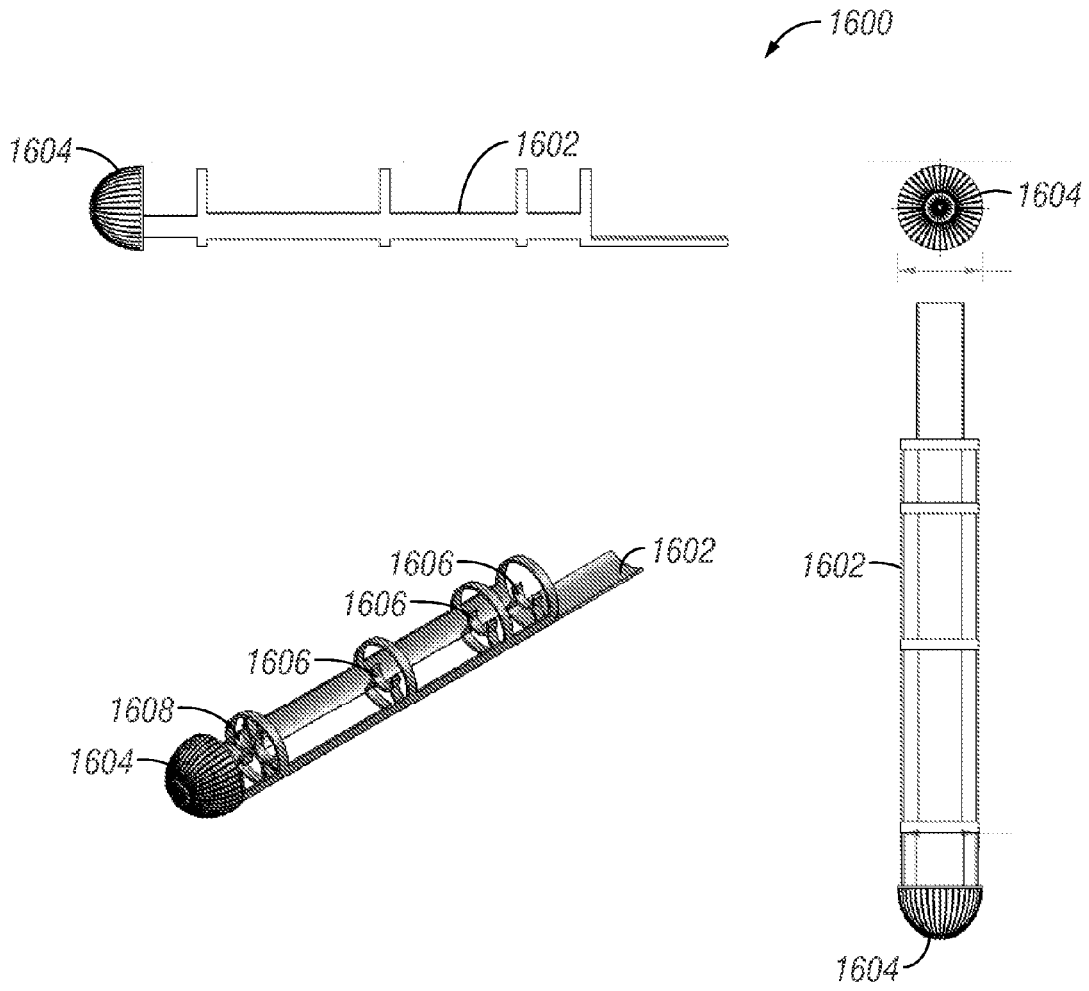
FIG. 16 is a pictorial representation of a chassis in accordance with an illustrative embodiment.

FIG. 16 provides a pictorial representation of a microphone 1600, a chassis design 1602 including a front 1604 and mounts 1606 and 1608 for one more microphone elements. The chassis 1602 includes a front 1604 that is preferably acoustically transparent. The chassis may be housed within sides or housing that is also acoustically transparent. One or more connectors may be housed or attached to the chassis 1602. In accordance with the illustrative embodiments herein, one or more microphone elements may be disposed as a microphone array using mounts 1608 adjacent the front 1604 of the chassis 1602. Similarly, one or more microphone or acting as a microphone array may be disposed adjacent the sides and back of the chassis 1602 using mounts 1606. Microphone 1600 is but one pictorial representation of a microphone chassis contemplated herein.

Figure 17:
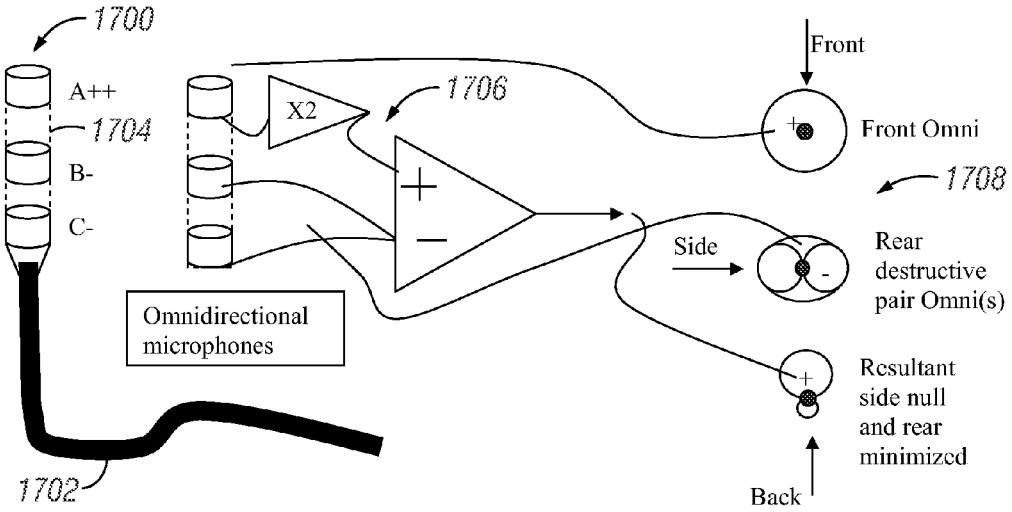
FIG. 17 is a pictorial representation of another microphone and pickup pattern in accordance with an illustrative embodiment.

FIG. 17 is a pictorial representation of a microphone 1700 in accordance with an illustrative embodiment. The microphone 1700 is shown by way of exemplary configuration where a microphone array 1704 is operatively configured or attached to a cord 1702. A microphone circuit diagram 1706 and polar diagram 1708 are illustrated showing the response of the microphone 1700. The microphone elements may be configured on omnidirectional microphones resulting in the polar diagram 1708. Although pressure gradient type microphones may be preferred, omnidirectional microphones may also be configured within one or more of the exemplary embodiments of the present disclosure. Although pressure gradient microphones may be preferred, omnidirectional microphones may also be utilized in one or more of the exemplary embodiments disclosed herein. By way of example, three omnidirectional microphones such as pictorially represented by microphone 1700 may be used. The resultant polar pattern or diagram 1708 shows side reduction, front angled response, and lowered rear response. In other omnidirectional microphone configurations, which are separated by a single distance, a common first order bidirection microphone is formed. In such, the rear lobe is as sensitive as the front lobe (e.g., all side rejection and no rear rejection). Conventional systems using two omnidirectional microphones are limited by the distance between microphones. If the distance is large enough to have a reasonable low frequency response, then phase notches appear in the front response and rear response. The distance can be made small enough between microphone elements to element the front phase notch having an adverse effect on the low frequency response. As pictorially represented by microphone 1700 shown in FIG. 17, one or more microphone elements may be spaced (i.e., separated by a distance) thereby providing a higher-order (e.g., second order) microphone. Using the destructive interference as set forth herein resulting from the rear two separated microphone elements, a destructive interference with the front microphone element is eliminated or generally lowered, thus allowing the distance between the microphone elements be larger than conventional microphones while retaining low frequency response. In such an embodiment, manufacturing is also simplified. The side response for microphone 1700 is lowered and can even be nulled. For example, the main on axis sound may be configured so not to include phase notches.

The rear response may be lowered so as not to include phase notches. The distance between the rear destructive pair of microphone elements may be subtracted from the front microphone or microphone elements which is separated by a balance between the signal from the front microphone(s) and the rear pair of microphone elements can be adjusted to give variations of polar responses from maximum side rejection to best overall rejection, for example, for different applications as contemplated herein. For example, it is possible with proper balance and distance between microphone elements to lower the rear sensitivity to near that of the lowered side level of sound reduction as represented pictorially by the microphone circuit diagram 1706 and polar diagram 1708 for the microphone array 1704 carried by the cord 1702.

Figure 18:
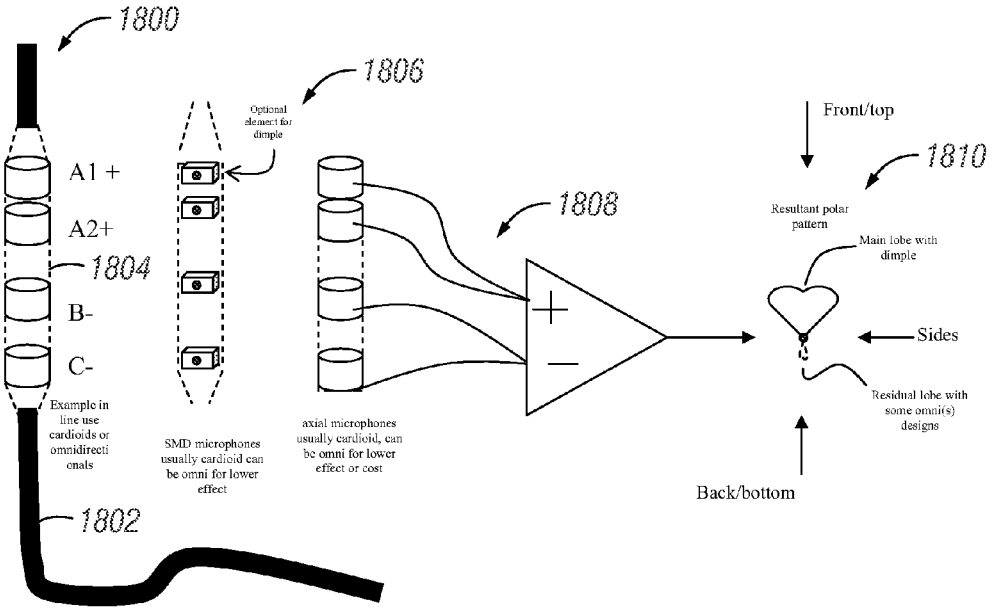
FIG. 18 is a pictorial representation of yet another microphone and pickup pattern in accordance with an illustrative embodiment.
Figure 19:
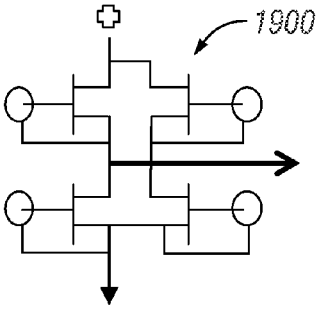
FIG. 19 is a pictorial representation of a circuit and electret elements in accordance with an illustrative embodiment.
Figure 20:
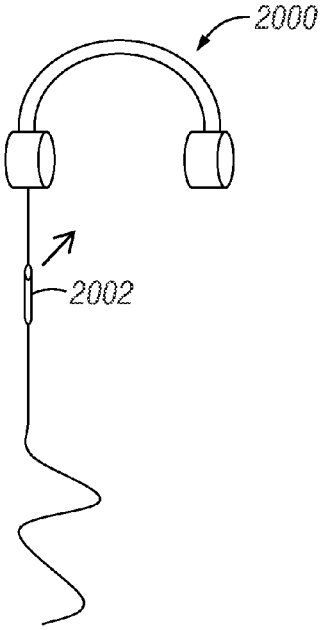
FIG. 20 is a pictorial representation of a headphone set and cord in accordance with an illustrative embodiment.

FIG. 18 provides a pictorial representation of a microphone 1800 in accordance with an illustrative embodiment. As previously discussed, the microphone array 1804 may include one or more cardioid or omnidirectional microphones. The microphone array 1804 may be carried by a cord 1802. Illustration 1806 provides another exemplary configuration for a microphone array. Microphone circuit diagram 1808 and polar diagram 1810 are provided for the microphone 1800 illustrated in FIG. 18. One exemplary implementation of the microphone 1800 is implemented in a headphone cord or cable such as illustrated in FIG. 20. Along with the other uses mentioned, such configuration of microphone 1800 may be implemented in an electronic device (e.g., a mobile phone) or other like electronic device. (See FIG. 34). Similarly, the microphone 1800 may be configured at the center connecting point between two ear bud type headphone cords (see FIG. 26). In such an embodiment, where microphone 1800 hangs from a headphone cord, additional modifications may be made to adjust or deform the front response to lower sound levels directly above the microphone and allow improved performance at/around 30 degrees from the microphone to improve pickup of the human voice of the person wearing the headphones. The front to back element balance may also be varied by need, for example, by using the analog differential circuit field-effect transistor and electret element pictorially represented in FIG. 19.

FIG. 21 provides a pictorial representation of a microphone 2100 operatively carried by a cord 2102. The microphone 2100 includes one or more microphone elements forming a microphone array 2104. FIG. 21 illustrates the capability of bearing the size of the microphone elements in the microphone array 2104. FIG. 22 provides a pictorial representation of a microphone 2200 where one or more microphone elements 2204 are carried by a cord 2202. The corded configuration of the microphone elements 2204 provide an inline use on the side of the cord 2202 with open spaces between each of the microphones. The cord may be configured so as to control the spacing between the microphone elements 2204. For example, the cord may include one or more stiffening elements to prevent the spacing between the microphone elements 2204 from being changed from a spacing pattern that produces the best results. FIG. 23 provides a pictorial representation of a microphone 2300 with microphone covers 2302, 2304 and 2306, which taken together form a cover array 2308. FIG. 23 illustrates the potential for the microphone elements 2204 shown in FIG. 22 to be covered using one or more artistic looking and fully functional covers 2302, 2304, and 2306 in accordance with an illustrative embodiment of the present disclosure. FIG. 24 provides a pictorial representation of a microphone 2400 with the microphone elements 2204 in FIG. 22 covered by one or more acoustically transparent covers 2404, 2406, and 2410 in the array of microphone covers 2408. The covers 2404, 2406 and 2410 may be configured to fully or partially cover a microphone element whereby the covers are operatively carried by a cord 2402 as pictorially represented in FIG. 24. As previously provided, an analog differential circuit field-effect transistor and electret elements by be fed or powered by a powered microphone input as pictorially represented by the differential circuit 2500 in FIG. 25. A microphone in accordance with the illustrative embodiments of the present disclosure may be configured in an ear bud cord 2600 as pictorially represented in FIG. 26.

Figure 27:
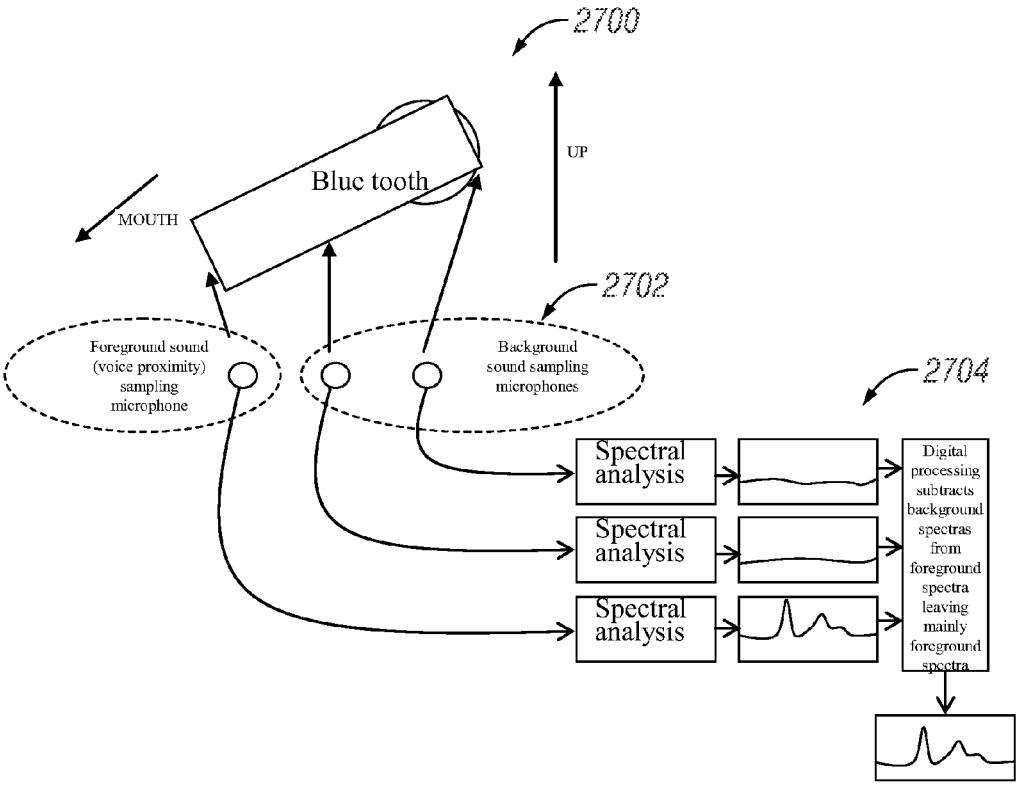
FIG. 27 is a pictorial representation of a headset and microphone system in accordance with an illustrative embodiment.

FIG. 27 provides a pictorial representation of a conventional microphone 2700. In the illustrated embodiment, the microphone is carried within a blue tooth headset and includes a microphone array 2702 and spectral diagram and resulting spectral diagram 2704. The headset includes one or more microphone elements, such as one or more for background sound sampling and one or more for foreground sound sampling. The sound source proximity is based with digital differentiation via spectrums as provided pictorially by the spectral diagram 2704. The digital processing subtracts background spectra from the foreground spectra leaving mainly foreground spectra. As illustrated, sound is digitally converted to spectrum which allows manipulations not generally possible in linear (conventional) audio such as only passing program signals which are above the background signal levels. Accordingly, the microphone, such as a headset microphone (including a Bluetooth microphone) may be configured using one or more of the microphone configuration and elements of the present disclosure.

Figure 28:
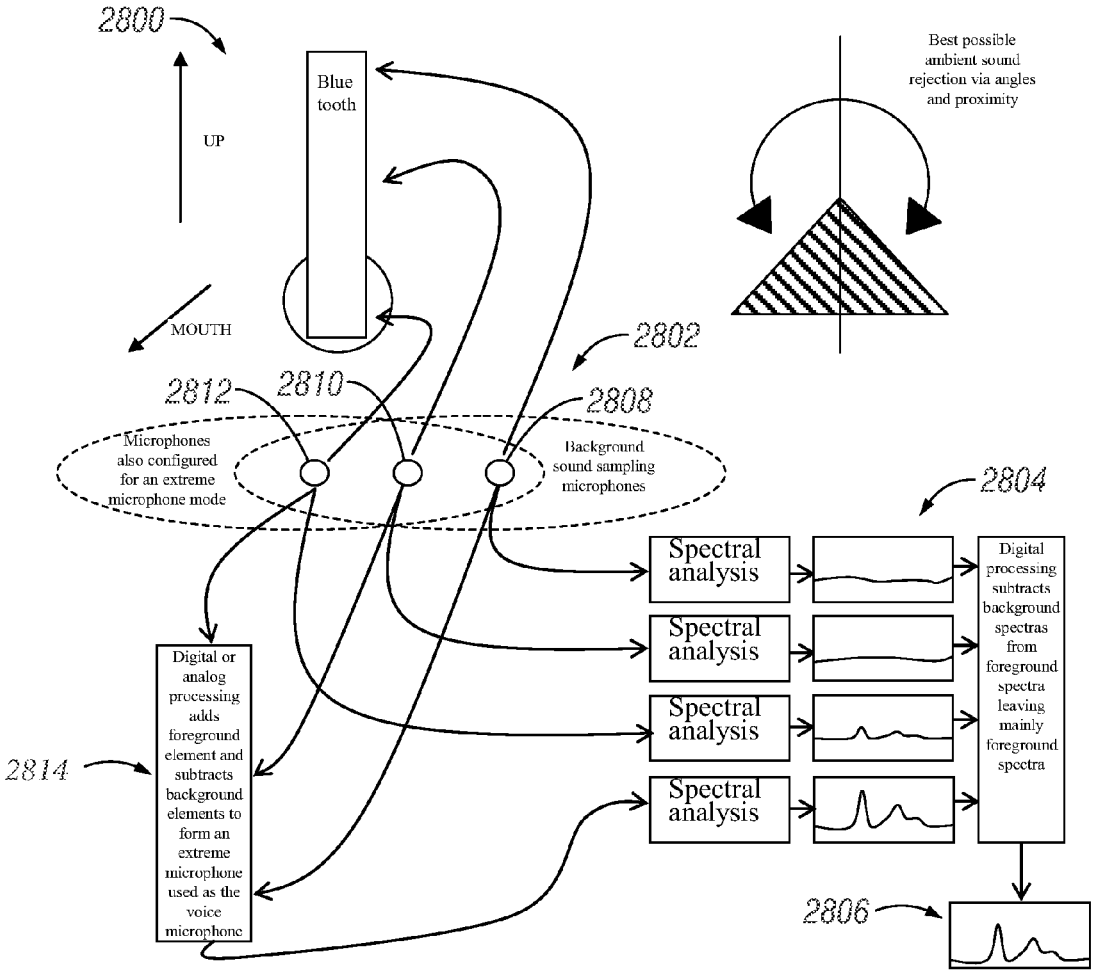
FIG. 28 is a pictorial representation of another headset and microphone system in accordance with an illustrative embodiment.

FIG. 28 provides a pictorial representation of a microphone 2800. The microphone may be configured, for example, as a Bluetooth headset. Microphone elements may be configured within the headset housing as described herein. One or more microphone elements 2808, 2810, and 2812 may be disposed within the housing. The microphones may be configured to form a microphone array 2802 within the housing whereby one or more of the microphones is background sound sampling and one or more of the microphones is configured to operate in accordance with one or more of the functions, processes and operations of the present disclosure. For example, the microphone elements 2808, 2810, and 2812 may be configured in accordance with the present disclosure, such as by operating microphone element 2808 in positive phase, microphone element 2810 in negative phase, and microphone element 2812 in negative phase. At least one pickup pattern description for the microphone array 2802 is shown at 2814. A spectral diagram 2804 and signal output diagram 2806 are pictorially represented in FIG. 28 for disclosing another operational or additional feature of the present disclosure. In accordance with one aspect of the microphone 2800, digital or analog processing (e.g., DSP shown by the lower spectral analysis line extending from 2814 to the bottom spectral analysis boxes shown in the spectral diagram 2804) subtracts/removes background elements even further from the output signal. Using, for example, DSP the frequency response is converted to a spectral signal (e.g., multiple slices of spectra over time) where background elements may be further removed from the output 2814 to form microphone 2800 in accordance with one or more of the objectives of the present disclosure. For example, as shown by the spectral diagram 2804, digital processing subtracts the background spectra from the foreground spectra leaving mainly foreground spectra providing response spectra in signal output diagram 2806. The signal output 2806 is further modified or improved, as discussed above, over the response 2814. In accordance with another aspect of the present disclosure, microphone 2800 may be configured with three mems in three different positions on the microphone housing chassis whereby the signal is rendered entirely by digital reproduction. According to another aspect, the signal may be rendered using a CPU or other electronic computing device. In this manner, where three microphone elements are spaced close in proximity to the mouth of the wearer, microphone element closest to the mouth is in positive phase and the second microphone is subtracted from the first microphone along with the back microphone resulting in a positive, negative, negative phase for the microphone array 2802. To perform one or more of the digital renditions, an analog to digital converter may be included with one or more of the embodiments to provide a digital signal processing ("DSP") arrangement. In this manner, for example, three omni microphones in sequence perform destructive interference with the rear microphone elements. Using the analog to digital converter, any choice of microphone may be used on a, for example, flexible cord or within a chassis such as the headset chassis illustrated in FIG. 28.

Figure 29:
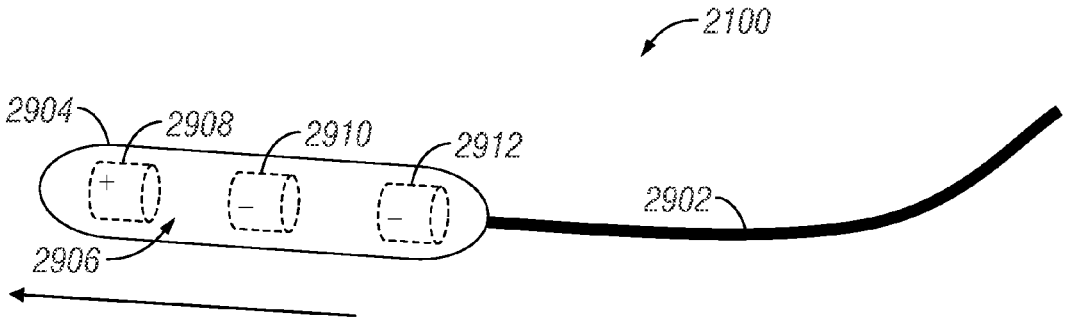
FIG. 29 is a pictorial representation of a hydrophone array in accordance with an illustrative embodiment.

FIG. 29 provides a pictorial representation of a hydrophone 2900 in accordance with an illustrative embodiment. The hydrophone 2900 includes a cord 2902, housing 2904 and microphone array 2906 with microphone elements 2908, 2910 and 2912. In this manner, the concept of the present disclosure may be included within a hydrophone 2900 as pictorially represented in FIG. 29. The concepts of the present disclosure are not limited to microphones but include acoustical pressure measurements where such are capable of being measured in various environments, such as in air or underwater. The hydrophone 2900 may be configured for forward looking (or trailing) sonar. The directional and interference cancelling work in other mediums such as water in accordance with the illustrative embodiments of the present disclosure. The hydrophone 2900 may also be configured to emit sonic pulses when not receiving, using a similar pattern to the receiving pattern.

Figure 30:
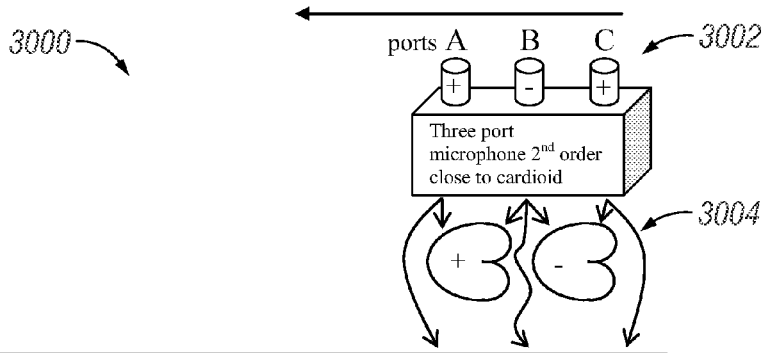
FIG. 30 is a pictorial representation of a three port microphone in accordance with an illustrative embodiment.
Figure 31:
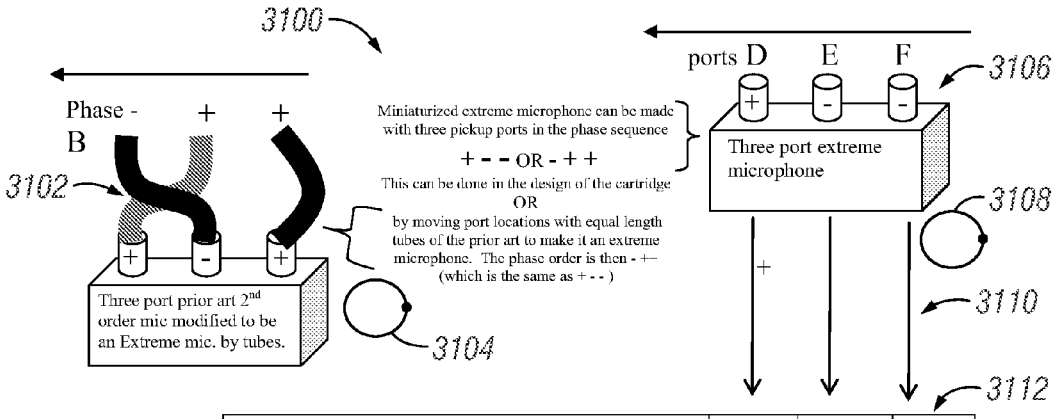
FIG. 31 is a pictorial representation of another three port microphone in accordance with an illustrative embodiment.

FIG. 30 provides a pictorial representation of a conventional microphone 3000. FIG. 30 illustrates a microphone array 3002, microphone circuit diagram 3004 and output diagram 3006 for conventional microphone 3000. Using three port microphones as pictorially represented (e.g., cardioid microphones) a second order conventional microphone can be made using a consolidation technique to make a second order cardioid using three pickup ports in the phase sequence plus-minus-plus as represented by the output diagram 3006. A modified microphone 3100 is provided in FIG. 31. Pictorially represented in FIG. 31 is a microphone 3100, microphone array 3102, polar diagram 3104, microphone array 3106, polar diagram 3108, output 3110, and output diagram 3112. The microphone array 3102 provides a pictorial representation of a microphone configured according to any conventional manner. The polar diagram 3104 provides a pictorial representation of the response of a conventional microphone configured as illustrated by the microphone array 3102. The concepts of the present disclosure, a conventional microphone may be configured in accordance with the microphone array 3106 resulting in the polar diagram 3108, output 3110 and output diagram 3112. The microphone array 3106 may be configured with three pickup ports in the phase sequence as illustrated. For example, the phase sequence may be plus-minus-minus or minus-plus-plus. The phase sequence can be configured using the chassis or cartridge or by moving port locations with equal length tubes for a conventional microphone to make a having one or more of the benefits of the present disclosure. Moving the port locations for a conventional microphone, the phase order for the microphone array 3106 may be changed to minus-plus-plus (which is the same as plus-minus-minus). The resulting output 3110 and output diagram 3112 provide a pictorial representation of the benefits in accordance with the illustrated aspects of the present disclosure, specifically the phase cancellation that occurs by using destructive interference from the side and the rear.

Figure 32:
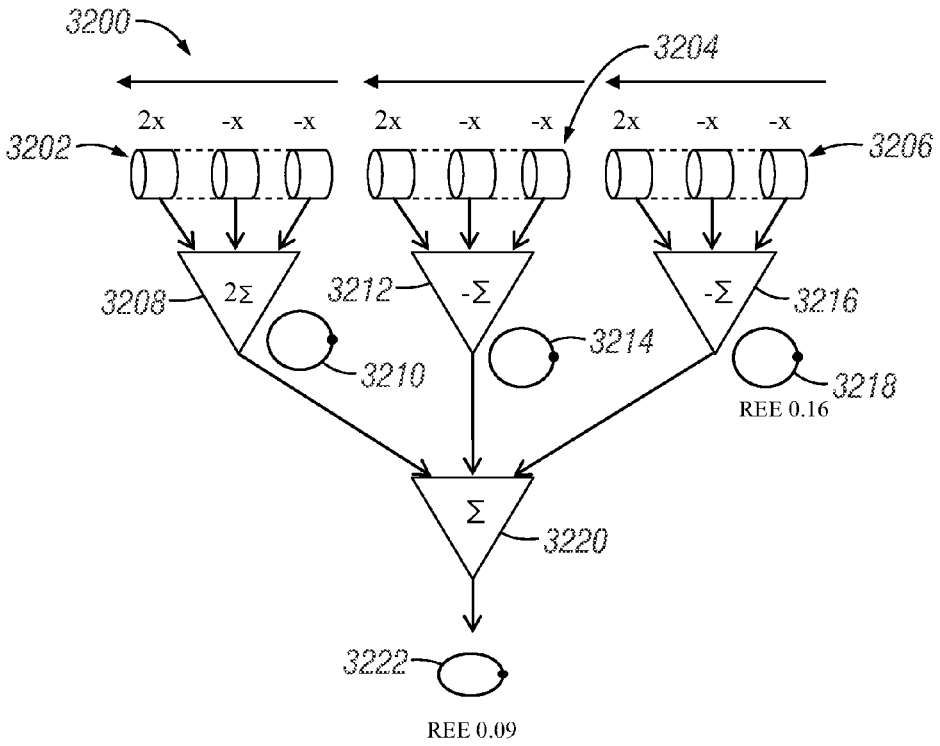
FIG. 32 is a pictorial representation of a microphone nesting concept in accordance with an illustrative embodiment.

FIG. 32 is a pictorial representation of a microphone 3200 in accordance with an illustrative embodiment of the present disclosure. FIG. 32 illustrates microphone 3200, microphone array 3202, microphone array 3204, microphone array 3206, array summation diagram 3208, polar diagram 3210, array summation diagram 3212, polar diagram 3214, array summation diagram 3216, polar diagram 3218, array summation output 3220, and polar diagram 3222. As with embodiments disclosed herein, the microphone elements may be configured inside a larger microphone (nesting) to produce a higher-order performance by allowing a wide microphone element spacing which preserves low frequency. An exemplary aspect of this concept is provided pictorially by microphone 3200 shown in FIG. 32. For example, microphone array 3202 is in positive phase whereas microphone arrays 3204 and 3206 are in negative phase. The resultant summation of array 3202 is shown by the array summation diagram 3208. Similarly, the resultant summation of array 3204 is shown by the array summation diagram 3212 and array 3206, and array summation diagram 3216. The array summation diagram 3208 has a positive phase whereas the array summation diagrams 3212 and 3216 are in negative phase. The polar diagrams 3210 and 3214 and 3218 provide pictorial representation of the output from each array, where polar diagram 3218 may have a random energy efficiency ("REE") of about 0.16, or better. The array summation output 3220 is in positive phase resulting in the polar diagram 3222 as pictorially represented. The polar diagram 3222 may have an REE of about 0.09, or better.

Figure 33:
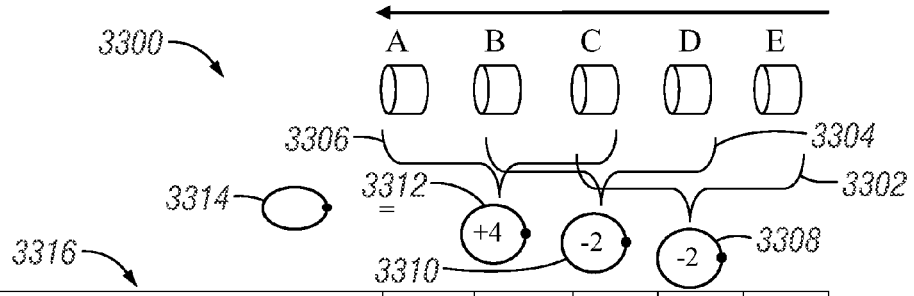
FIG. 33 is a pictorial representation of another higher-order microphone in accordance with an illustrative embodiment.

FIG. 33 provides a pictorial representation of a microphone 3300 in accordance with an illustrative embodiment. FIG. 33 shows a pictorial representation of a microphone 3300 in accordance with a consolidated embodiment of the microphone 3200 shown in FIG. 32. FIG. 33 illustrates a microphone 3300, microphone array 3302, microphone array 3304, microphone array 3306, polar diagram 3308, polar diagram 3310, polar diagram 3312, summation polar diagram 3314, and output diagram 3316. The response, for example, may be taken from microphone array 3302, from microphone elements C, D and E. The response for the microphone array 3304 may be taken from microphone elements B, C and D and for microphone array 3306 from microphone elements A, B and C. The resultant polar diagrams 3308, 3310 and 3312 for each are pictorially represented having a summation polar diagram 3314. The gain for each microphone element is shown in the output diagram 3316 for the illustrated embodiment of microphone 3300.

Figure 34:
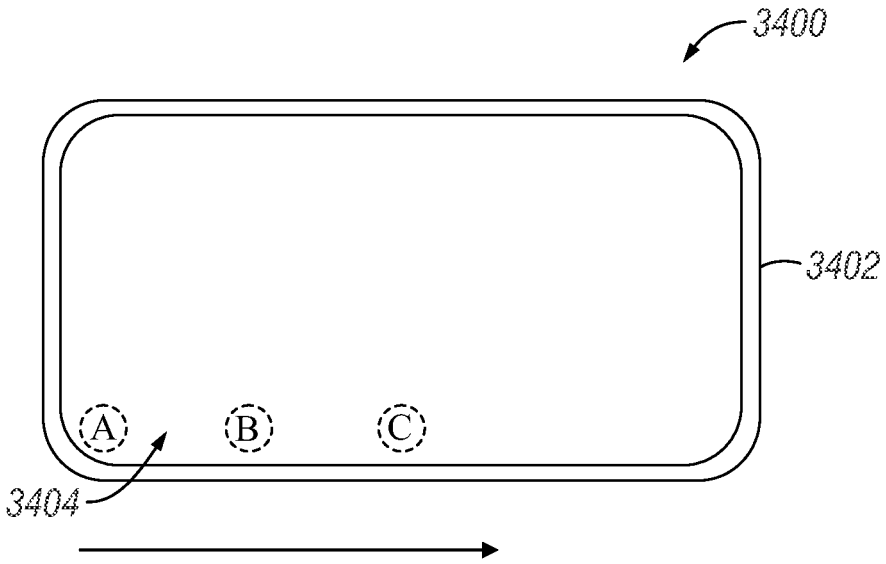
FIG. 34 is a pictorial representation of an electronic device and microphone array in accordance with an illustrative embodiment.

FIG. 34 provides a pictorial illustration of an electronic device 3400 having a housing 3402 within which or on one or more microphone elements are disposed forming a microphone array 3404 operating in accordance with the processes, features and operations herein described. For example, a Smartphone or other like electronic device may be configured with the microphone array 3404 to operate in accordance with the objectives for a higher-order microphone described herein. The microphone array 3404 may be operated in combination with a digital signal processor for further spectral gating/noise reduction in accordance with an exemplary embodiment of the present disclosure.

Figure 35:
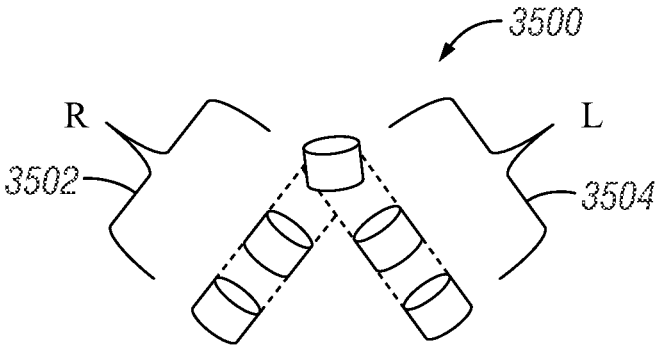
FIG. 35 is a pictorial representation of another higher-order microphone in accordance with an illustrative embodiment.

FIG. 35 provides a pictorial representation of a microphone 3500, microphone array 3502 and microphone array 3504. The microphone arrays 3502 and 3504 may be used together sharing a common front element to produce multichannel microphones with the absence of phase difference between channels. As pictorially represented, microphone 3500 may be configured for stereo, but as many directions can be use simultaneously as required in the microphone 3500 may be mixed with lower-order conventional microphones by way of example.

As further contemplated herein, a single microphone element may be used to acquire a front and rear and/or side response. For example, a ribbon microphone may be used and the timing difference between the pickup responses may be adjusted in accordance with the processes, functions and operations of the present disclosure to provide a destructive interference signal to generally annul a side or rear response acquired by a single microphone element. In accordance with another embodiment, one or more omnidirectional microphones may be disposed within a housing whereby one omnidirectional microphone is aiming forward and one or more omnidirectional microphones are aimed sideways in the back whereby they subtract one from the other to produce a bidirectional microphone in accordance with an exemplary aspect of the present disclosure.

The present invention is not to be limited to the particular embodiments described herein. In particular, the present invention contemplates numerous variations in the type of ways in which embodiments of the invention may be applied to higher-order microphones using destructive interference. The foregoing description has been presented for purposes of illustration and description. It is not intended to be an exhaustive list or limit any of the disclosure to the precise forms disclosed. It is contemplated that other alternatives or exemplary aspects that are considered included in the disclosure. The description is merely examples of embodiments, processes or methods of the invention. It is understood that any other modifications, substitutions, and/or additions may be made, which are within the intended spirit and scope of the disclosure. For the foregoing, it can be seen that the disclosure accomplishes at least all of the intended objectives.

The previous detailed description is of a small number of embodiments for implementing the invention and is not intended to be limiting in scope. The following claims set forth a number of the embodiments of the invention disclosed with greater particularity.

What is claimed is:

1. An acoustical pressure measurement device for receiving and transducing acoustic energy including an acoustic pressure source comprising:

a. a microphone comprising a housing, one or more microphone elements at the housing, and a microphone circuit between the one or more microphone elements and a microphone line out conduit;

b. the one or more microphone elements configured to:

1. generate a first acoustic pressure measurement signal from a first acoustic pressure measurement from a generally concentrated spatial location relative the housing;

2. generate a second acoustic pressure measurement signal from a second acoustic pressure measurement having:

i. a spatiality greater than the concentrated spatial location of the first acoustic pressure measurement; and ii. at least one destructive interference signal portion relative the first acoustic pressure measurement signal;

iii. wherein the at least one destructive interference signal portion is characterized at least in part by the spatiality of the second acoustic pressure measurement;

c. the microphone circuit combining the first and second measurement signals to the microphone line out conduit.

2. The device of claim 1 wherein the one or more microphone elements comprise:

a single microphone element taking both the first and second acoustic pressure measurements.

3. The device of claim 1 wherein the one or more microphone elements comprise:

a. a first microphone element array taking the first acoustic pressure measurement; and b. a second microphone element array taking the second acoustic pressure measurement.

4. The device of claim 1 wherein the spatiality comprises a spatial separation between:

a. portions of the same microphone element; or b. two or more microphone elements.

5. The device of claim 1 wherein the spatiality is characterized by the housing comprising opposing boundaries related to the first and second acoustic pressure measurements.

6. The device of claim 1 further comprising:

a third acoustic pressure measurement within the spatiality of the second acoustic pressure measurement taken by:

a. a single microphone element;

b. one or more additional microphone elements.

7. The device of claim 6 wherein the second and third acoustic pressure measurements have generally an opposing response magnitude relative to the first acoustic pressure measurement.

8. The device of claim 1 wherein the at least one destructive interference signal portion from the second acoustic pressure measurement is configured to decrease destructive interference from a primary direction of directivity of an acoustic pressure source.

9. A method for an acoustical pressure measurement, of a received acoustic pressure source comprising:

acquiring with one or more microphone elements a first acoustic pressure measurement from a generally concentrated spatial location;

acquiring with the one or more microphone elements a second acoustic pressure measurement having a spatiality greater than the concentrated spatial location of the first acoustic pressure measurement;

combining at least one destructive interference portion from the second acoustic pressure measurement with the first acoustic measurement in an output signal;

characterizing the at least one destructive interference portion at least in part by the spatiality of the second acoustic pressure measurement;

directing the output signal to an output.

10. The method of claim 9 further comprising:

acquiring both the first and second acoustic pressure measurements with a single microphone element.

11. The method of claim 9 further comprising:

acquiring the first acoustic pressure measurement with a first microphone element array and the second acoustic pressure measurement with a second microphone element array.

12. The method of claim 9 further comprising:

decreasing destructive interference from a primary direction of directivity for an acoustic pressure source using the at least one destructive interference measurement from the second acoustic pressure measurement.

13. The method of claim 9 further comprising:

taking the first and second acoustic pressure measurements at generally opposing boundaries of one or more microphone element arrays.

14. The method of claim 9 further comprising:

acquiring a third acoustic pressure measurement within the spatiality of the second acoustic measurement.

15. The method of claim 9 further comprising:

characterizing generally at least one measurement boundary for the spatiality with the second pressure measurement.

16. A second order acoustic sensor comprising—:

a body having sides extending between opposing front and rear ends;

a first set of one or more acoustic sensor elements in a relatively small space at the front end of the body and generating a first sensor signal in response to received acoustic energy;

a second set of one or more acoustic sensor elements away from the front end in a space larger than the relatively small space at the front end and generating a second sensor signal in response to the received acoustic energy;

wherein the second set of sensor elements is configured to provide a destructive interference signal portion relative the first sensor signal; and wherein the received acoustic energy includes a primary direction of directivity for an acoustic energy source;

wherein the second set of sensor elements is configured to lower destructive interference from the primary direction of directivity from the acoustic energy source.

17. The second order microphone of claim 16 wherein the one or more acoustic sensor elements comprises a microphone.

18. The second order microphone of claim 16 further comprising:

wherein the second set of acoustic sensor elements is configured at the rear of the body.

19. The second order microphone of claim 18 wherein the first set of acoustic sensors comprises a first microphone element array configured at the front of the body and the second set of acoustic sensors comprises a second microphone element array configured towards the rear of the body.

20. The second order microphone of claim 19 further comprising:

a gain between the first microphone element array and the second microphone element array.

21. The second order microphone of claim 19 wherein the first microphone element array has a front response and the second microphone element array has a rear response, wherein the rear response includes the destructive interference signal portion to remove one or more notches in the front response while promoting cancellation of received acoustic energy from the sides of the body.

22. The second order microphone of claim 21 wherein the front response and the rear response are subtracted from each other, wherein at least some of rear and side received acoustic energy are nullified.

23. A method for providing front sensitivity and at least reduced side or rear sensitivity in a higher-order microphone, the method comprising:

providing a body having sides extending between front and rear ends;

positioning a first set of microphone sensor elements towards the front end of the body for generating a first transduced signal;

positioning a second set of microphone sensor elements towards the rear end of the body;

configuring the second set of microphone sensor elements to provide a destructive interference signal relative the first transduced signal;

acquiring a source of acoustic energy having a primary direction of directivity;

using the destructive interference signal of the second set of microphone sensor elements to improve directional sensitivity to the source of acoustic energy from the primary direction of directivity.

24. The method of claim 23 wherein each of the microphone sensor elements comprises a cardioid type sensitivity pattern.

25. The method of claim 23 further comprising:

configuring the second set of microphone sensor elements at variable positions in a space towards the rear end of the body.

26. The method of claim 23 further comprising:

configuring the first set of microphone elements in a first microphone array in a relatively small space towards the front end of the body and the second set of microphone elements in a second microphone array in a relatively larger space towards the rear end of the body.

27. The method of claim 26 further comprising:

adjusting a gain between the first microphone array and the second microphone array.

28. The method of claim 26 further comprising: removing signal notches in a front response of the microphone while promoting cancellation from sides and rear using the destructive interference signal portion in a rear response from the second microphone array.

29. The method of claim 23 further comprising:

generally nullifying a rear response and a side response by subtracting a front response from the rear response.

30. The method of claim 23 further comprising:

acquiring the source of acoustic energy with another set of microphone sensor elements spaced from the second set of microphone sensor elements at the rear end of the body.

* * * * *